US012773035B2

(12) United States Patent
Bishop et al.

(10) Patent No.: US 12,773,035 B2
(45) **Date of Patent: *Oct. 27, 2026**

(54) VACUUM TRANSFORM UPPER FOR ARTICLE OF FOOTWEAR

(71) Applicant: NIKE, Inc., Beaverton, OR (US)

(72) Inventors: Jennifer L. Bishop, Portland, OR (US); Timothy P. Hopkins, Tustin, CA (US); Viviane Labelle, Portland, OR (US); Nicholas R. Long, Portland, OR (US); Todd W. Miller, Portland, OR (US); Nadia M. Panian, Beaverton, OR (US); Aaron K. Seid, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/329,110

(22) Filed: Sep. 15, 2025

(65) Prior Publication Data

US 2026/0007208 A1 Jan. 8, 2026

Related U.S. Application Data

(63) Continuation of application No. 17/719,861, filed on Apr. 13, 2022, now Pat. No. 12,433,370.

(60) Provisional application No. 63/174,763, filed on Apr. 14, 2021.

(51) Int. Cl.
*A43B 1/00* (2006.01)
*A43B 23/02* (2006.01)

(52) U.S. Cl.
CPC ..... *A43B 23/0285* (2013.01); *A43B 1/0009* (2013.01); *A43B 23/0205* (2013.01); *A43B 23/029* (2013.01)

(58) Field of Classification Search
CPC ..... A43B 1/0009; A43B 3/26; A43B 23/028; A43B 23/029; A43B 23/26
See application file for complete search history.

(56) References Cited

U.S. PATENT DOCUMENTS

| | | | |
|---|---|---|---|
| 1,596,923 | A | 8/1926 | Cooney |
| 3,685,176 | A | 8/1972 | Rudy |
| 5,392,534 | A | 2/1995 | Grim |
| 5,617,650 | A | 4/1997 | Grim |
| 5,784,807 | A | 7/1998 | Pagel |

(Continued)

FOREIGN PATENT DOCUMENTS

| | | | |
|---|---|---|---|
| WO | WO-2016100170 | A1 | 6/2016 |
| WO | WO-2017023532 | A1 | 2/2017 |

OTHER PUBLICATIONS

European Patent Office as ISA, International Search Report and Written Opinion for PCT App. No. PCT/US2022/024763, mailed Jun. 20, 2022.

(Continued)

*Primary Examiner* — Sharon M Prange
(74) *Attorney, Agent, or Firm* — Honigman LLP; Matthew H. Szalach

(57) ABSTRACT

An adjustment element for an article of footwear includes a bladder having a barrier layer defining an interior void and a compressible component disposed within the interior void and including a lattice structure defining a plurality of reliefs formed in the lattice structure, the compressible component operable between an expanded state when the interior void includes a first pressure and a contracted state when the interior void includes a second pressure.

20 Claims, 24 Drawing Sheets

(56) References Cited

U.S. PATENT DOCUMENTS

| | | | |
|---|---|---|---|
| 6,195,914 | B1 | 3/2001 | Otis |
| 7,131,218 | B2 | 11/2006 | Schindler |
| 7,278,445 | B2 | 10/2007 | Marvin et al. |
| 7,380,351 | B1 | 6/2008 | Pavone et al. |
| 7,478,488 | B1 | 1/2009 | Davis et al. |
| 9,060,564 | B2 | 6/2015 | Langvin et al. |
| 9,451,803 | B2 | 9/2016 | Smith |
| 10,602,801 | B2 | 3/2020 | Silva |
| 2003/0046831 | A1 | 3/2003 | Westin |
| 2003/0097767 | A1 | 5/2003 | Perkinson |
| 2004/0003517 | A1 | 1/2004 | Marvin et al. |
| 2012/0167413 | A1 | 7/2012 | Marvin et al. |
| 2016/0122493 | A1 | 5/2016 | Farris et al. |
| 2016/0242502 | A1 | 8/2016 | Spanks |
| 2016/0249706 | A1 | 9/2016 | Leary et al. |
| 2017/0042286 | A1 | 2/2017 | Meschter et al. |
| 2017/0215516 | A1 | 8/2017 | Silva |
| 2017/0360155 | A1 | 12/2017 | Leary et al. |
| 2017/0360590 | A1 | 12/2017 | Corrigan et al. |
| 2018/0064207 | A1 | 3/2018 | Hurd et al. |
| 2018/0110286 | A1 | 4/2018 | Vuong |
| 2018/0255865 | A1 | 9/2018 | Hsu |
| 2019/0000186 | A1 | 1/2019 | Mou et al. |
| 2019/0110557 | A1 | 4/2019 | Hobson et al. |
| 2019/0117419 | A1 | 4/2019 | Finke |
| 2019/0208855 | A1 | 7/2019 | Raia |
| 2019/0216167 | A1 | 7/2019 | Hoffer et al. |
| 2019/0261739 | A1 | 8/2019 | Taylor et al. |
| 2019/0365042 | A1 | 12/2019 | Weast et al. |
| 2020/0037705 | A1 | 2/2020 | Frank et al. |
| 2020/0375319 | A1 | 12/2020 | Yang |
| 2021/0114507 | A1 | 4/2021 | Alexander et al. |
| 2021/0120915 | A1 | 4/2021 | Panian |
| 2021/0169177 | A1 | 6/2021 | Yang |
| 2021/0235819 | A1 | 8/2021 | Andreasen et al. |
| 2021/0244128 | A1 | 8/2021 | Costa et al. |
| 2021/0368941 | A1 | 12/2021 | Chen et al. |
| 2022/0104582 | A1 | 4/2022 | Christensen et al. |
| 2022/0395058 | A1 | 12/2022 | Petrie et al. |
| 2023/0033238 | A1 | 2/2023 | Hopkins et al. |

OTHER PUBLICATIONS

USPTO, Final Office Action for U.S. Appl. No. 17/719,861, mailed Apr. 11, 2024.

European Patent Office (ISA), International Search Report and Written Opinion for PCT App. No. PCT/US2023/019734, mailed Aug. 2, 2023.

European Patent Office (ISA), International Search Report and Written Opinion for PCT App. No. PCT/US2022/082024, mailed Apr. 18, 2023.

VACUUM TRANSFORM UPPER FOR ARTICLE OF FOOTWEAR

CROSS REFERENCE TO RELATED APPLICATIONS

This application is a continuation of U.S. Non-Provisional application Ser. No. 17/719,861, filed Apr. 13, 2022, which claims priority under 35 U.S.C. § 119 (e) to U.S. Provisional Application Ser. No. 63/174,763, filed on Apr. 14, 2021. The disclosures of these prior applications are considered part of the disclosure of this application and are hereby incorporated by reference in their entirety.

FIELD

The present disclosure relates generally to an adjustment device for an article of apparel or footwear.

BACKGROUND

This section provides background information related to the present disclosure which is not necessarily prior art.

Articles of apparel such as garments and headwear and articles of footwear such as shoes and boots, typically include a receptacle for receiving a body part of a wearer. For example, an article of footwear may include an upper and a sole structure that cooperate to form a receptacle for receiving a foot of a wearer. Likewise, garments and headwear may include one or more pieces of material formed into a receptacle for receiving a torso or head of a wearer.

Articles of apparel or footwear are typically adjustable and/or are formed from a relatively flexible material to allow the article of apparel or footwear to accommodate various sizes of wearers, or to provide different fits on a single wearer. While conventional articles of apparel and articles of footwear are adjustable, such articles do not typically allow a wearer to conform the shape of the article to a body part of the wearer. For example, while laces adequately secure an article of footwear to a wearer by contracting or constricting a portion of an upper around the wearer's foot, the laces do not cause the upper to conform to the user's foot. Accordingly, an optimum fit of the upper around the foot is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
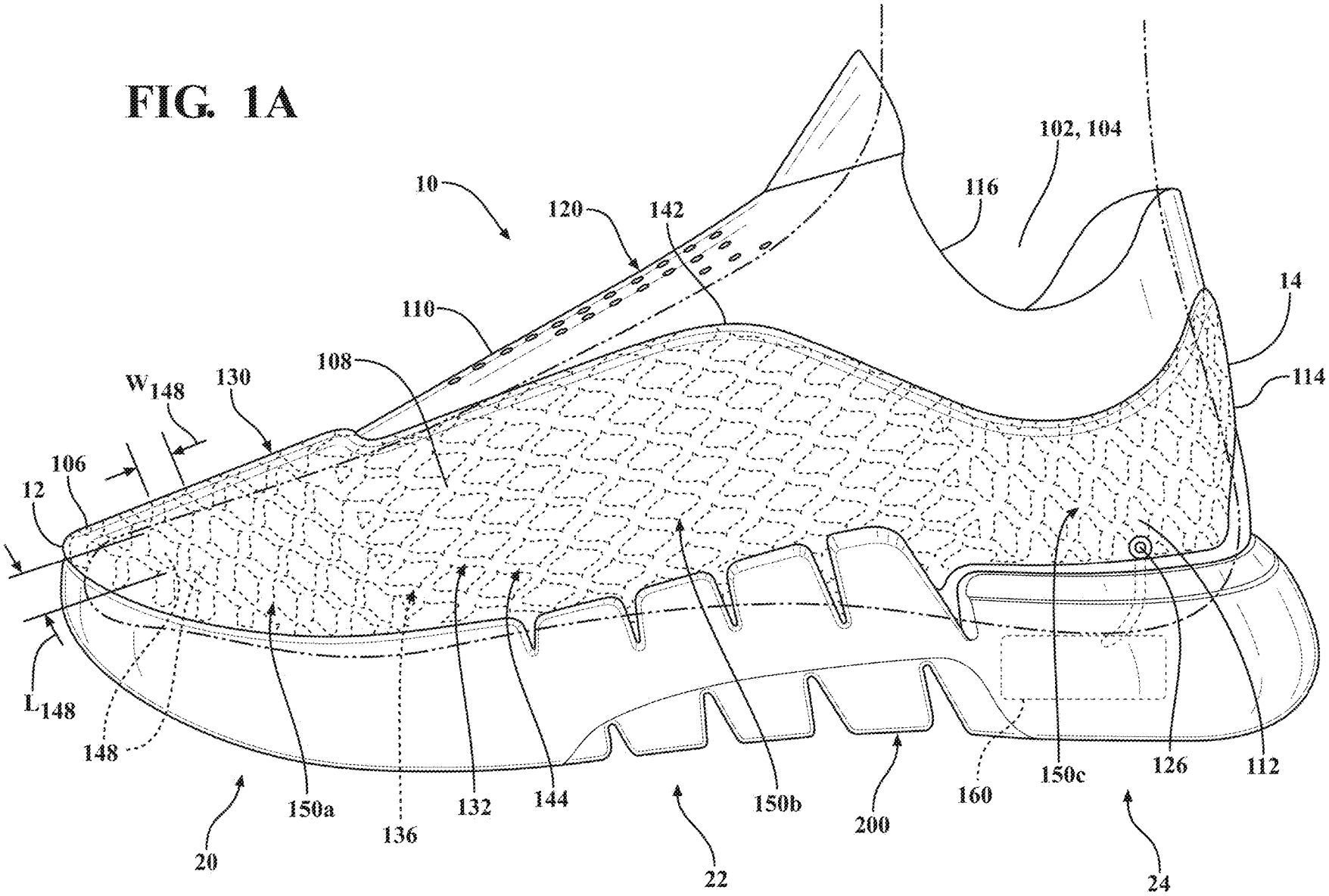
FIG. 1A is a lateral side view of an example of an article of footwear according to the present disclosure, where the article of footwear is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

An adjustment element for an article of footwear includes a bladder having a barrier layer defining an interior void and a compressible component disposed within the interior void and including a lattice structure defining a plurality of reliefs formed in the lattice structure, the compressible component operable between an expanded state when the interior void includes a first pressure and a contracted state when the interior void includes a second pressure.

The adjustment element may include one or more of the following optional features. For example, the reliefs may be parallelogram-shaped and may extend through a thickness of the compressible component. Additionally or alternatively, the lattice structure may define a first adjustment zone including a first plurality of reliefs oriented in a first direction and a second adjustment zone including a plurality of reliefs oriented in a second direction different from the first direction.

In one configuration, the compressible component may include a resilient polymeric material. The resilient polymeric material may be a foam material.

A port may be connected to the barrier layer and may provide fluid communication between the interior void and a variable pressure source. Additionally or alternatively, the first pressure may be equal to or greater than ambient pressure and the second pressure may be less than ambient pressure.

The adjustment element may include an interior seam separating the bladder into a first chamber and a second chamber. Further, the adjustment element may form an upper of an article of footwear.

In one configuration, the compressible component may include a first plurality of the reliefs operable to contract in a first direction in a forefoot region of the upper and a second plurality of the reliefs operable to contract in a second direction in a mid-foot region of the upper.

In another configuration, an article of footwear includes a bootie defining an interior void and an adjustment element attached to the bootie and including a bladder having a barrier layer defining an interior void and a compressible component disposed within the interior void, the compressible component including a lattice structure defining a plurality of reliefs formed in the lattice structure, the compressible component operable between an expanded state when the interior void includes a first pressure and a contracted state when the interior void includes a second pressure.

The article of footwear may include one or more of the following optional features. For example, the reliefs may be parallelogram-shaped and extend through a thickness of the compressible component. Additionally or alternatively, the lattice structure may define a first adjustment zone including a first plurality of the reliefs oriented in a first direction and a second adjustment zone including a second plurality of the reliefs oriented in a second direction different from the first direction. The first plurality of the reliefs may be operable to contract in a first direction in a forefoot region and the second plurality of the reliefs may be operable to contract in a second direction in a mid-foot region.

In one configuration, the compressible component may include a resilient polymeric material. The resilient polymeric material may be a foam material.

A port may be connected to the barrier layer and may provide fluid communication between the interior void and a variable pressure source. Additionally or alternatively, the first pressure may be equal to or greater than ambient pressure and the second pressure may be less than ambient pressure.

The adjustment element may include an interior seam separating the bladder into a first chamber and a second chamber. Further, the bootie may be exposed along a throat region of the article of footwear.

The details of one or more implementations of the disclosure are set forth in the accompanying drawings and the description below. Other aspects, features, and advantages will be apparent from the description and drawings, and from the claims.

Referring to FIGS. 1-4, an article of footwear 10 includes an upper 100 and a sole structure 200 attached to the upper 100. The footwear 10 may further include an anterior end 12 associated with a forward-most point of the footwear, and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 is associated with phalanges and metatarsal bones of a foot. The mid-foot region 22 may correspond with an arch area of the foot, and the heel region 24 may correspond with rear portions of the foot, including a calcaneus bone.

The upper 100 defines an interior void 102 and an ankle opening 104, which cooperate to receive and secure a foot for support on the sole structure 200. The upper 100, and components thereof, may be described as including various subcomponents or regions. For example, the upper 100 includes a toe cap 106 disposed at the anterior end 12 and extending over the toes from the medial side 16 to the lateral side 18. A pair of quarter panels 108 extend from the toe cap 106 in the mid-foot region 22 on opposite sides of the interior void 102. A throat 110 extends across the top of the upper 100 and defines an instep region extending between the quarter panels 108 from the toe cap 106 to the ankle opening 104. In the illustrated example, the throat 110 is enclosed, whereby a material panel extends between the opposing quarter panels 108 in the instep region to cover the interior void 102. Here, the material panel covering the throat 110 may be formed of a material having a higher modulus of elasticity than the material forming the quarter panels 108.

The upper 100 of the article of footwear 10 may be further described as including heel side panels 112 extending through the heel region 24 along the medial and lateral sides 16, 18 of the ankle opening 104. A heel counter 114 wraps around the posterior end 14 of the footwear 10 and connects the heel side panels 112. Uppermost edges of the throat 110, the heel side panels 112, and the heel counter 114 cooperate to form a collar 116, which defines the ankle opening 104 of the interior void 102.

In the example of FIGS. 1A-4B, the upper 100 includes an inner bootie 120 defining the interior void 102. The bootie 120 may be formed from one or more materials that are stitched or adhesively bonded together to define the interior void 102. Suitable materials of the upper bootie may include, but are not limited to, textiles, foam, leather, and synthetic leather. The example bootie 120 may be formed as an inner liner including a combination of one or more substantially inelastic or non-stretchable materials and one or more substantially elastic or stretchable materials disposed in different regions of the bootie 120 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

Figure 12A:
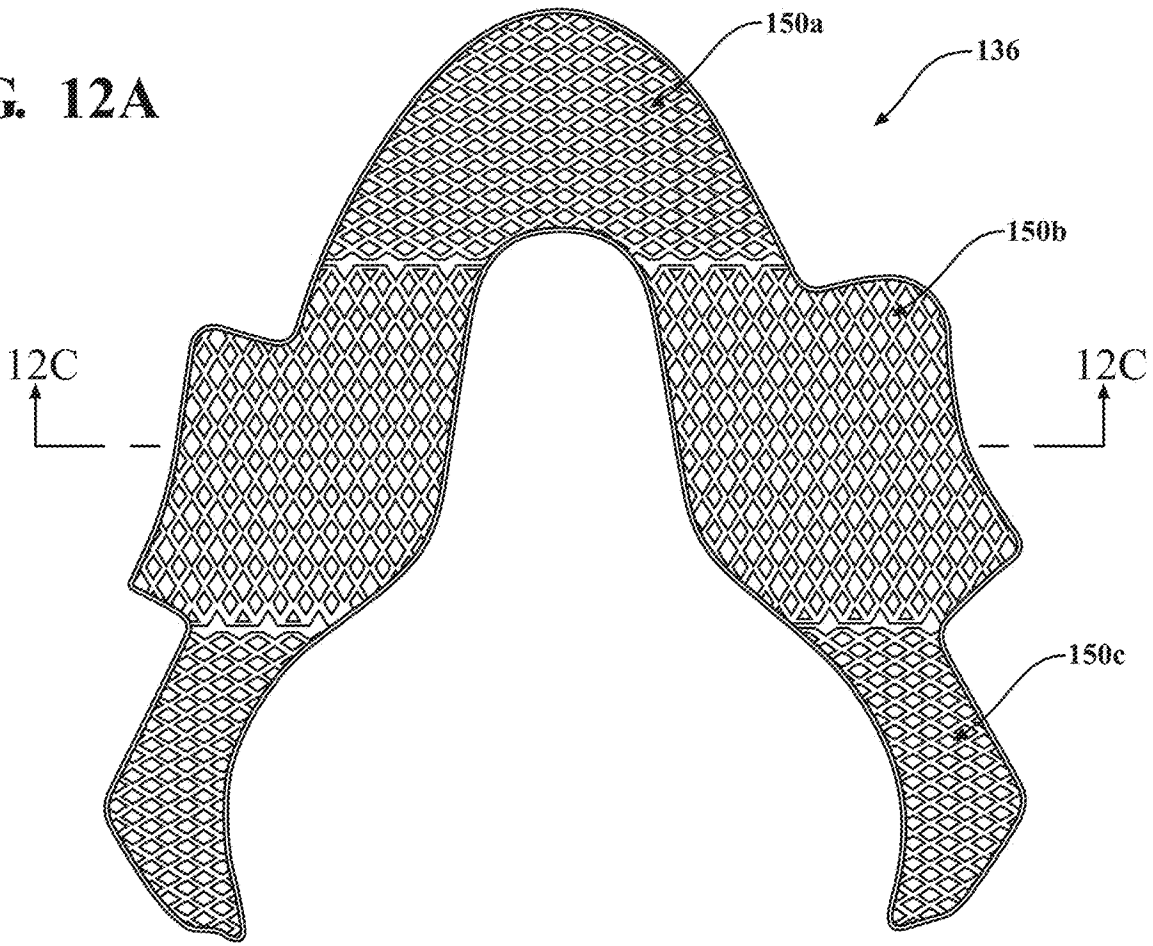
FIG. 12A-12C show steps and components for forming an example compressible component according to the present disclosure.
Figure 12B:
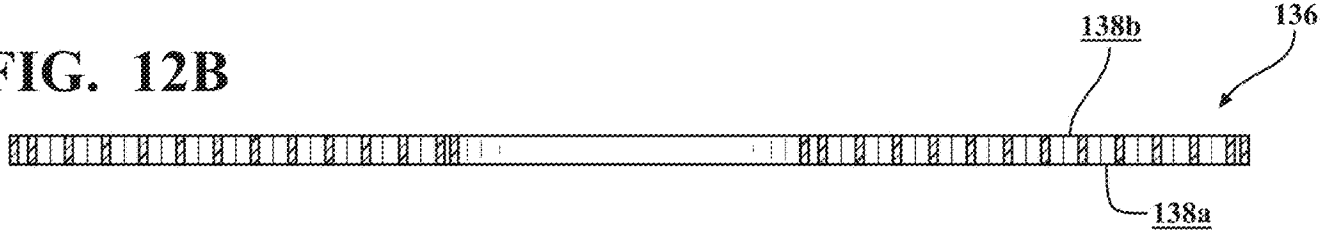
Figure 12C:
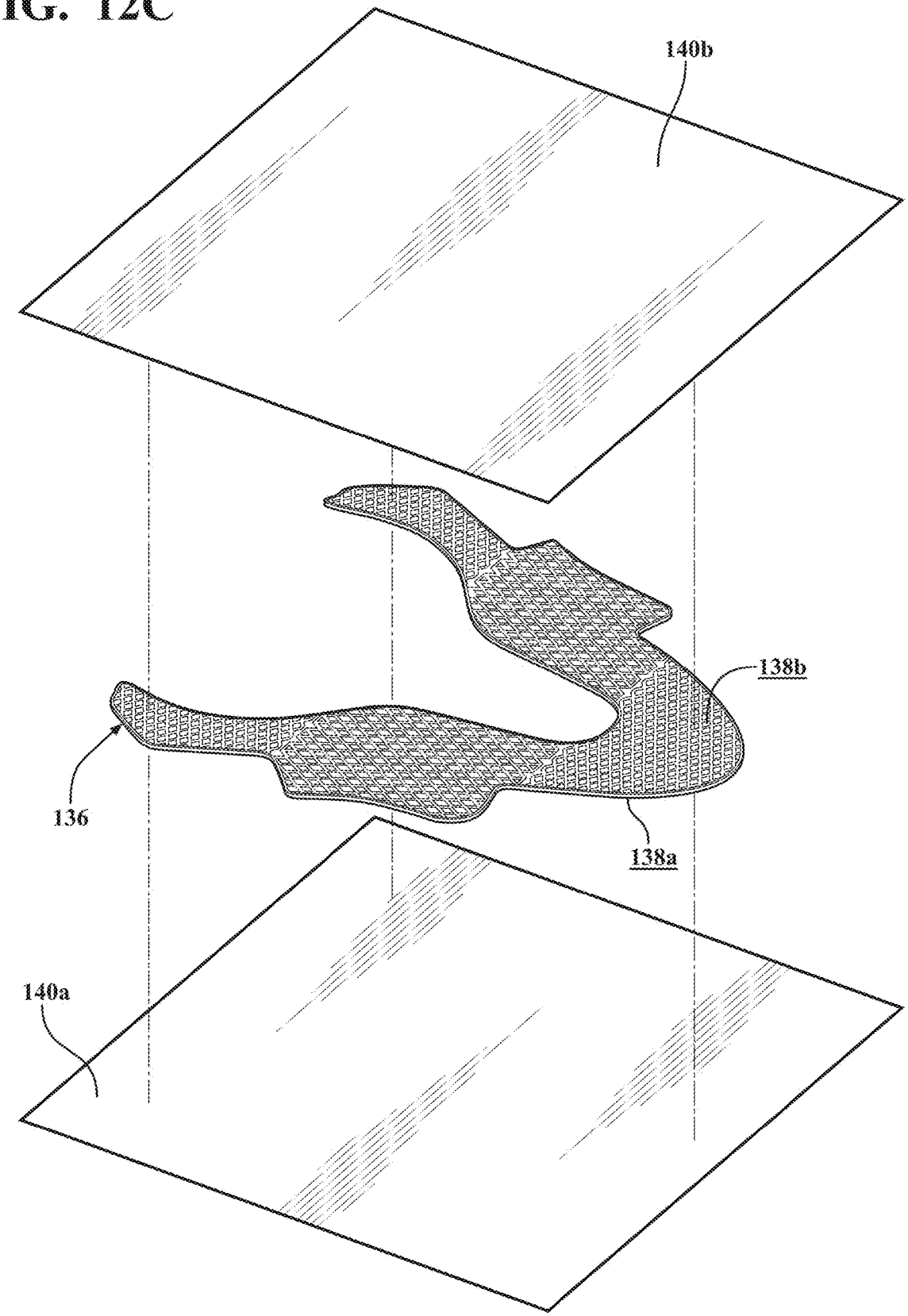

The upper 100 further includes an integrated adjustment element 130 attached to the bootie 120. The adjustment element 130 includes a bladder 132 forming an interior void 134 having a compressible component 136 disposed therein. As shown in FIGS. 12A-12C, the compressible component 136 includes a first surface **138*a* on a first side of the compressible component and a second surface 138*b* on an opposite second side of the compressible component. A distance from the first surface 138*a* to the second surface 138*b* defines a thickness of the compressible component 136. As discussed in greater detail below, the compressible component 136 is operable to transition the adjustable element 130 and the upper 100 between a relaxed state (FIGS. 1A and 2A) and a constricted state (FIGS. 1B and 2B**).

Figure 3:
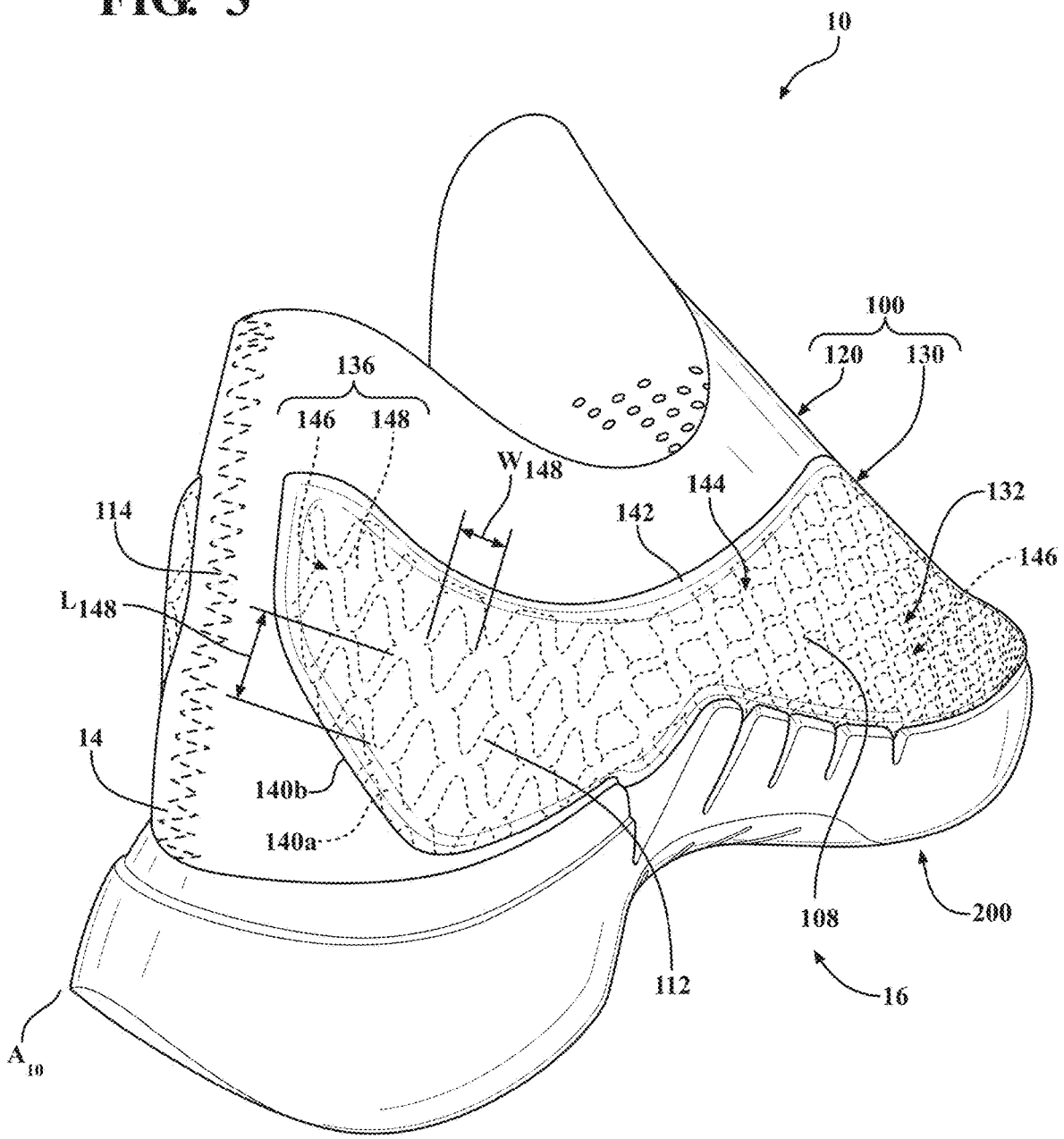
FIG. 3 is a rear perspective view of the article of footwear of FIG. 1A.
Figure 4A:
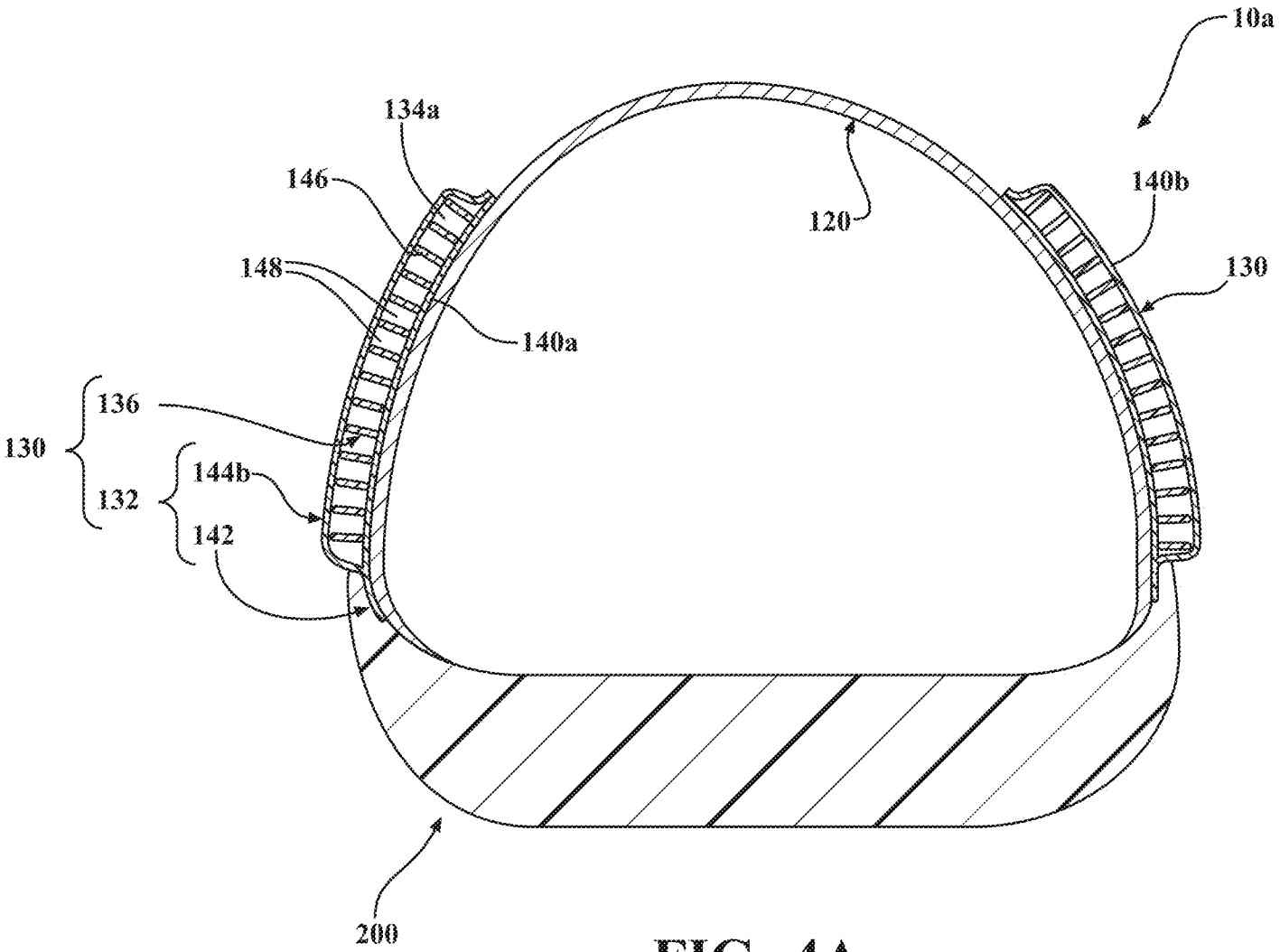
FIG. 4A is a cross-sectional view of the article of footwear of FIG. 2A, taken along Line 4A-4A in FIG. 2A.
Figure 4B:
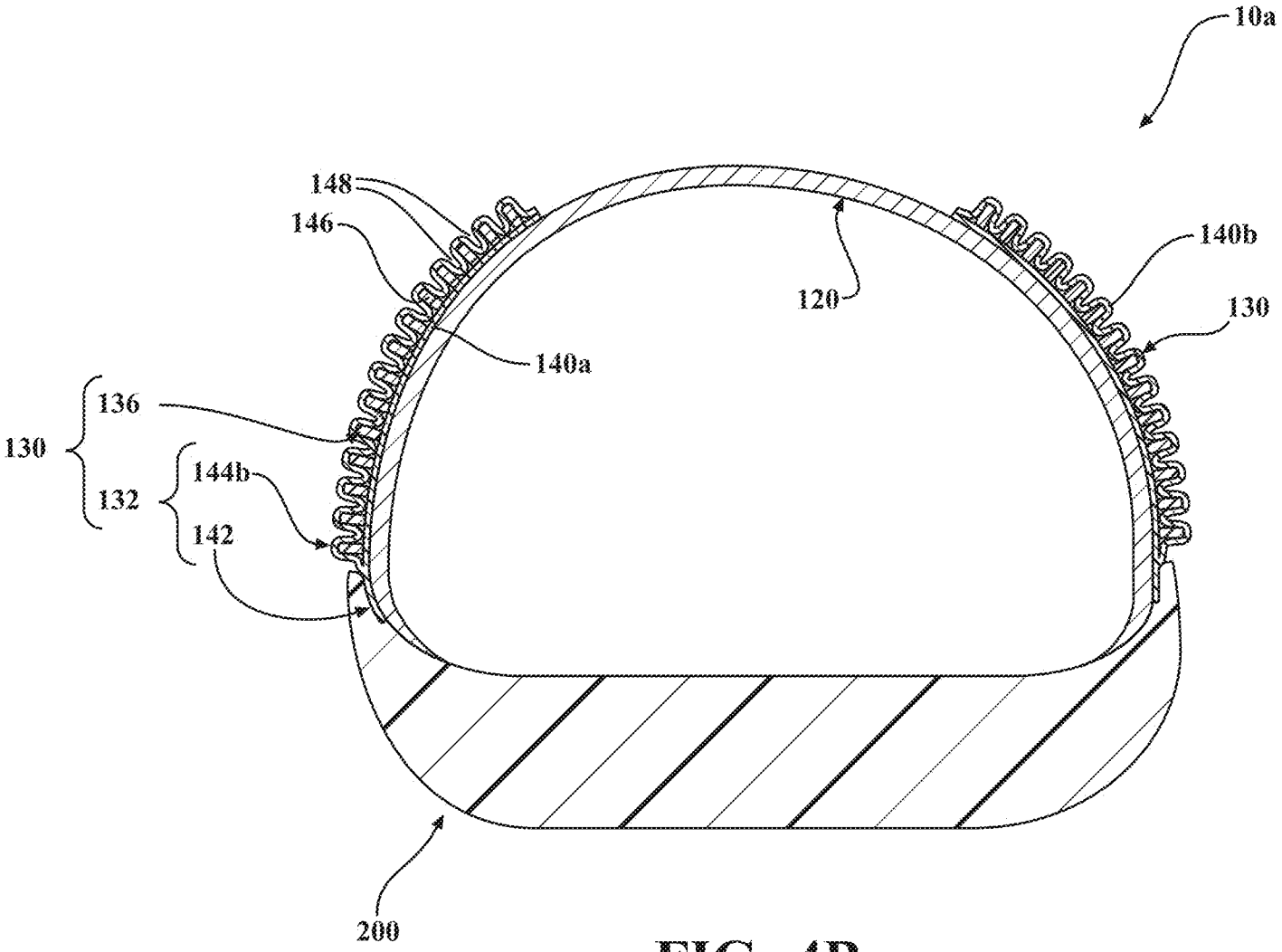
FIG. 4B is a cross-sectional view of the article of footwear of FIG. 2B, taken along Line 4B-4B in FIG. 2B.

In the illustrated example, the adjustment element 130 includes a toe portion including or defining toe cap 106 of the upper 100 and a pair of side portions extending along the medial and lateral sides 16, 18 on opposite sides of the throat 110 from the toe cap 106 to the heel region 24. As shown, each of the side portions include or define a respective quarter panel 108 and heel side panel 112 of the upper 100 on one of the medial side 16 and the lateral side 18. Thus, the throat 110 of the upper 100 is defined by the material of the bootie 120 and does not include the adjustment element 130. As shown in FIG. 3, the side portions of the adjustment element 130 each terminate along the respective medial and lateral sides 16, 18 of the heel counter 114 such that the bootie 120 is exposed and unrestrained along the posterior end 14. Accordingly, the ankle opening 104, the throat 110, and the heel counter 114 are defined only by an elastic material of the bootie 120 and may stretch to a greater extent than portions 106, 108, 112 of the upper 100 including the adjustment element 130, thereby allowing the upper 100 to stretch around to foot to be easily donned and doffed.

In the illustrated example, the adjustment element 130 includes an inner barrier layer **140*a* attached to an exterior surface of the bootie 120, and an outer barrier layer 140*b* defining at least a portion of an exterior surface of the upper 100. Interior surfaces of the barrier layers 140*a*, 140*b* face each other and are joined to each other at discrete locations to form a peripheral seam 142 that surrounds the interior void 134 to define a chamber 144 of the bladder 132**.

As used herein, the term "barrier layer" (e.g., barrier layers **140*a*, 140*b*) encompasses both monolayer and multilayer films. In some embodiments, one or both of barrier layers the 140*a*, 140*b* are each produced (e.g., thermoformed or blow molded) from a monolayer film (a single layer). In other embodiments, one or both of the barrier layers 140*a*, 140*b*** are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers **140*a*, 140*b*** can independently be transparent, translucent, and/or opaque. As used herein, the term "transparent" for a barrier layer and/or a chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers **140*a*, 140*b*** can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 140*a*, 140*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 140*a*, 140*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 140*a*, 140*b* may each independently include alternating sublayers of one or more TPU copolymer materials and one or more EVOH copolymer materials, where the total number of sublayers in each of the barrier layers 140*a*, 140*b* includes at least four (4) sublayers, at least ten (10) sublayers, at least twenty (20) sublayers, at least forty (40) sublayers, and/or at least sixty (60) sublayers.

The chamber 144 can be produced from the barrier layers 140*a*, 140*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 140*a*, 140*b* can be produced by co-extrusion followed by vacuum thermoforming to produce an inflatable chamber 144, which can optionally include one or more valves (e.g., one way valves) that allows the chamber 144 to be filled with the fluid (e.g., gas).

The chamber 144 can be provided in a fluid-filled (e.g., as provided in footwear 10) or in an unfilled state. The chamber 144 can be filled to include any suitable fluid, such as a gas or liquid. In an aspect, the gas can include air, nitrogen ($N_2$), or any other suitable gas. In other aspects, the chamber 144 can alternatively include other media, such as pellets, beads, ground recycled material, and the like (e.g., foamed beads and/or rubber beads). The fluid provided to the chamber 144 can result in the chamber 144 being pressurized. Alternatively, the fluid provided to the chamber 144 can be at atmospheric pressure such that the chamber 144 is not pressurized but, rather, simply contains a volume of fluid at atmospheric pressure.

The chamber 144 desirably has a low gas transmission rate to preserve its retained gas pressure. In some embodiments, the chamber 144 has a gas transmission rate for nitrogen gas that is at least about ten (10) times lower than a nitrogen gas transmission rate for a butyl rubber layer of substantially the same dimensions. In an aspect, chamber 144 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 140*a*, 140*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the inner barrier layer 140*a* and the outer barrier layer 140*b* cooperate to define a geometry (e.g., thicknesses, width, and lengths) of the chamber 144. The peripheral seam 142 may extend around the chamber 144 to seal the fluid (e.g., air) within the chamber 144. Thus, the chamber 144 is associated with an area of the bladder 132 where interior surfaces of the upper and lower barrier layers 140*a*, 140*b* are not joined together and, thus, are separated from one another.

In some examples, the barrier layers 140*a*, 140*b* may include the same materials to provide the chamber 144 with a homogenous barrier construction, such that both sides of the adjustment element 130 will contract and relax at the same rate when pressure within the chamber 144 is adjusted. Alternatively, a first one of the barrier layers 140*a*, 140*b* may be at least partially constructed of a different barrier material and/or configuration than the other one of the barrier layers 140*a*, 140*b* to selectively impart a contour as the adjustment element 130 transitions between the relaxed state and the contracted state. For example, one of the barrier layers 140*a*, 140*b* may be at least partially formed with a different modulus of elasticity and/or stiffness than the other barrier layer 140*a*, 140*b*, such that when the adjustment element 130 transitions from the relaxed state to the contracted state, the first one of the barrier layers 140*a*, 140*b* contracts at a different rate than the other barrier layer 140*a*, 140*b* to cause the adjustment element to curl.

The compressible component 136 is disposed within the interior void 134 of the adjustment element 130 and forms a transformable structure operable to transition the upper 100 between the relaxed state and the constricted state. The first surface 138*a* of the compressible component 136 faces the inner barrier layer 140*a* and the second surface 138*b* faces the outer barrier layer 140*b*. In this example, the compressible component 136 includes a collapsible lattice structure 146 having a plurality of apertures or reliefs 148 formed through the thickness (i.e., direction from the inner barrier layer 140*a* to the outer barrier layer 140*b*) of the compressible component 136. Generally, when a pressure within the chamber 144 is reduced, the lattice structure 146 is configured to collapse within the chamber 144 to transition the adjustment element 130 and the upper 100 from the relaxed or expanded state to the constricted state.

One or both surfaces 138*a*, 138*b* of the compressible component 136 may be attached to the corresponding barrier layer 140*a*, 140*b* when the adjustment element 130 is assembled. In one configuration, one or both of the first surface 138*a* and the second surface 138*b* may be fully attached to the corresponding one of the barrier layers 140*a*, 140*b*. Thus, as the compressible component 136 moves between the relaxed state and the contracted state, the surfaces 138*a*, 138*b* of the compressible component 136 directly pull the barrier layers 140*a*, 140*b* to transition the barrier layers 140*a*, 140*b* between the relaxed state and the contracted state.

In other examples, one or both of the surfaces 138*a*, 138*b* of the compressible component 136 may be fully detached from the barrier layers 140*a*, 140*b*. In this configuration, the barrier layers 140*a*, 140*b* are free to slide with respect to the surfaces 138*a*, 138*b* of the compressible component 136 as the compressible component 136 transitions between the relaxed state and the contracted state. Here, the barrier layers 140*a*, 140*b* may be indirectly influenced into the relaxed and contracted states by the compressible component 136.

In other implementations, at least one of the surfaces 138*a*, 138*b* of the compressible component 136 may be partially attached to the barrier layers 140*a*, 140*b*. For example, the compressible component 136 may be attached to the barrier layers 140*a*, 140*b* along a periphery of the surface 138*a*, 138*b* such that the interior region of the respective surface 138*a*, 138*b* is detached or independent from the barrier layers 140*a*, 140*b*. Thus, as the compressible component 136 transitions between the relaxed state and the contracted state, the barrier layers 140*a*, 140*b* are influenced into the relaxed state and the contracted state by the outer periphery of the compressible component 136. Alternatively, at least one of the surfaces 138*a*, 138*b* of the compressible component 136 may be zonally attached to a respective one of the barrier layers 140*a*, 140*b*. For instance, one or both of the surfaces 138*a*, 138*b* may be attached to the respective barrier layer 140*a*, 140*b* at one of the adjustment zones 150*a*-150*c* and detached from the barrier layer 140*a*, 140*b* at another one of the adjustment zones 150*a*-150*c*.

Figure 1B:
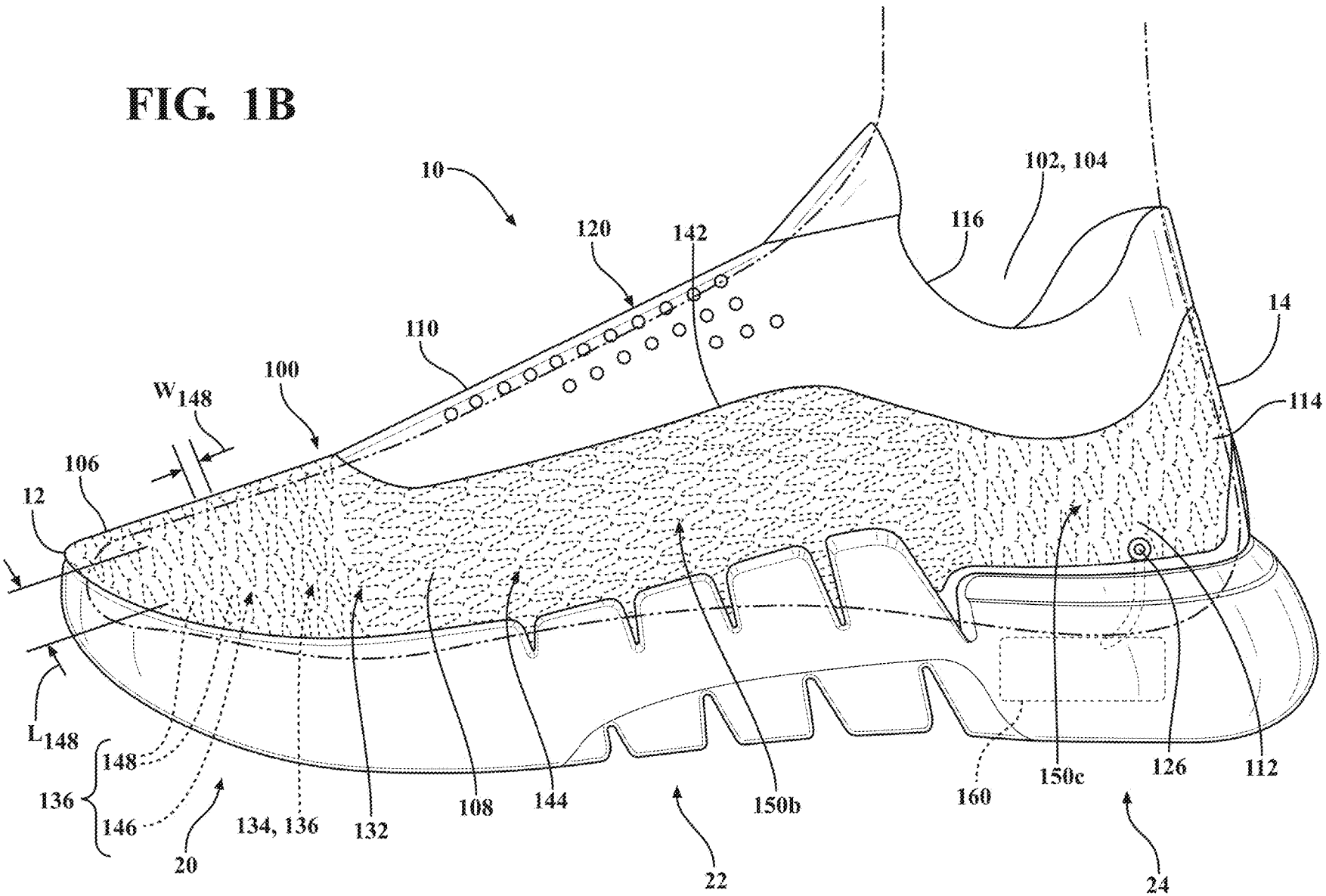
FIG. 1B is a lateral side view of the article of footwear in FIG. 1A, where the article of footwear is in a contracted state.
Figure 2A:
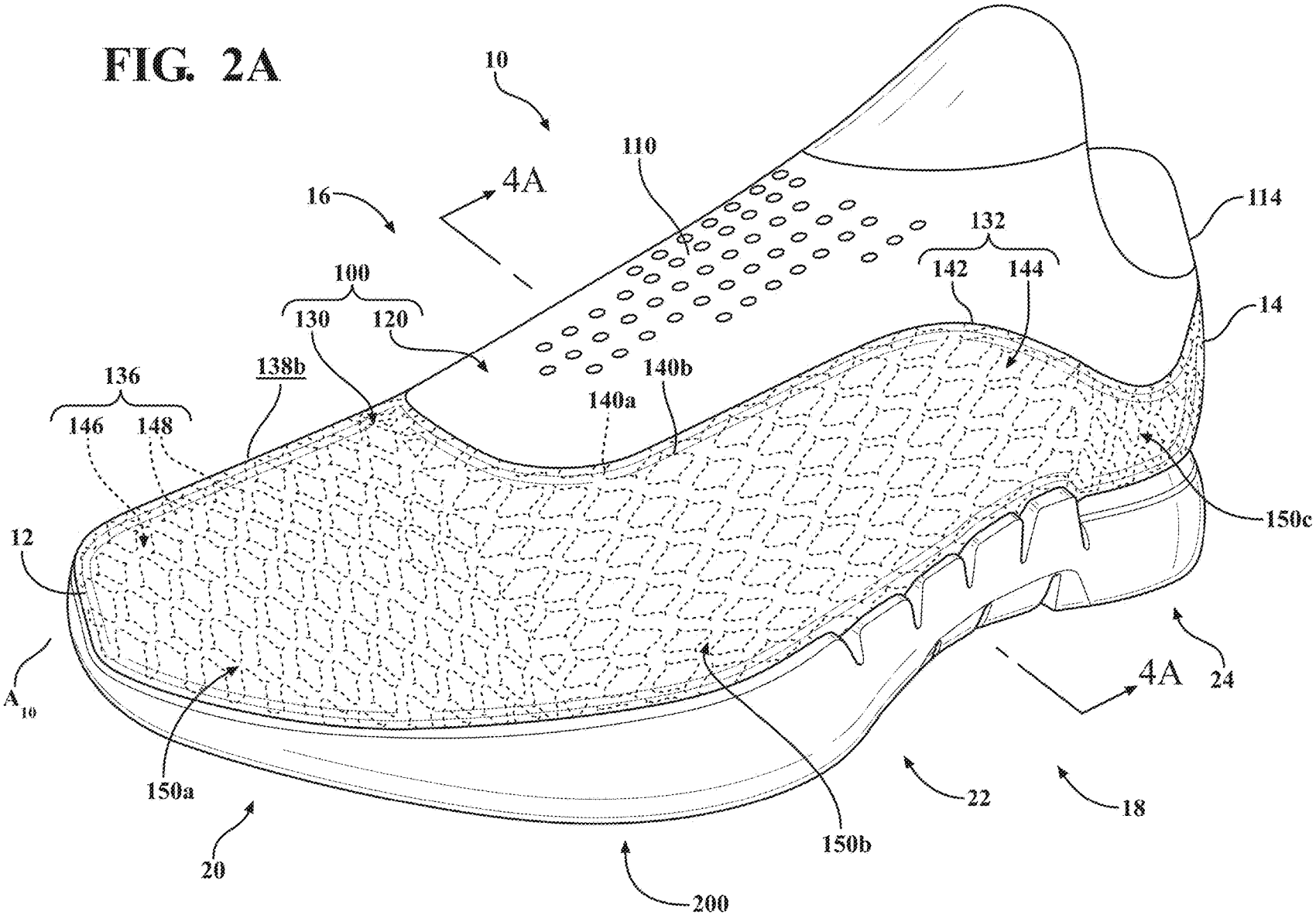
FIG. 2A is a front perspective view of the article of footwear of FIG. 1A, where the article of footwear is in the relaxed state.
Figure 2B:
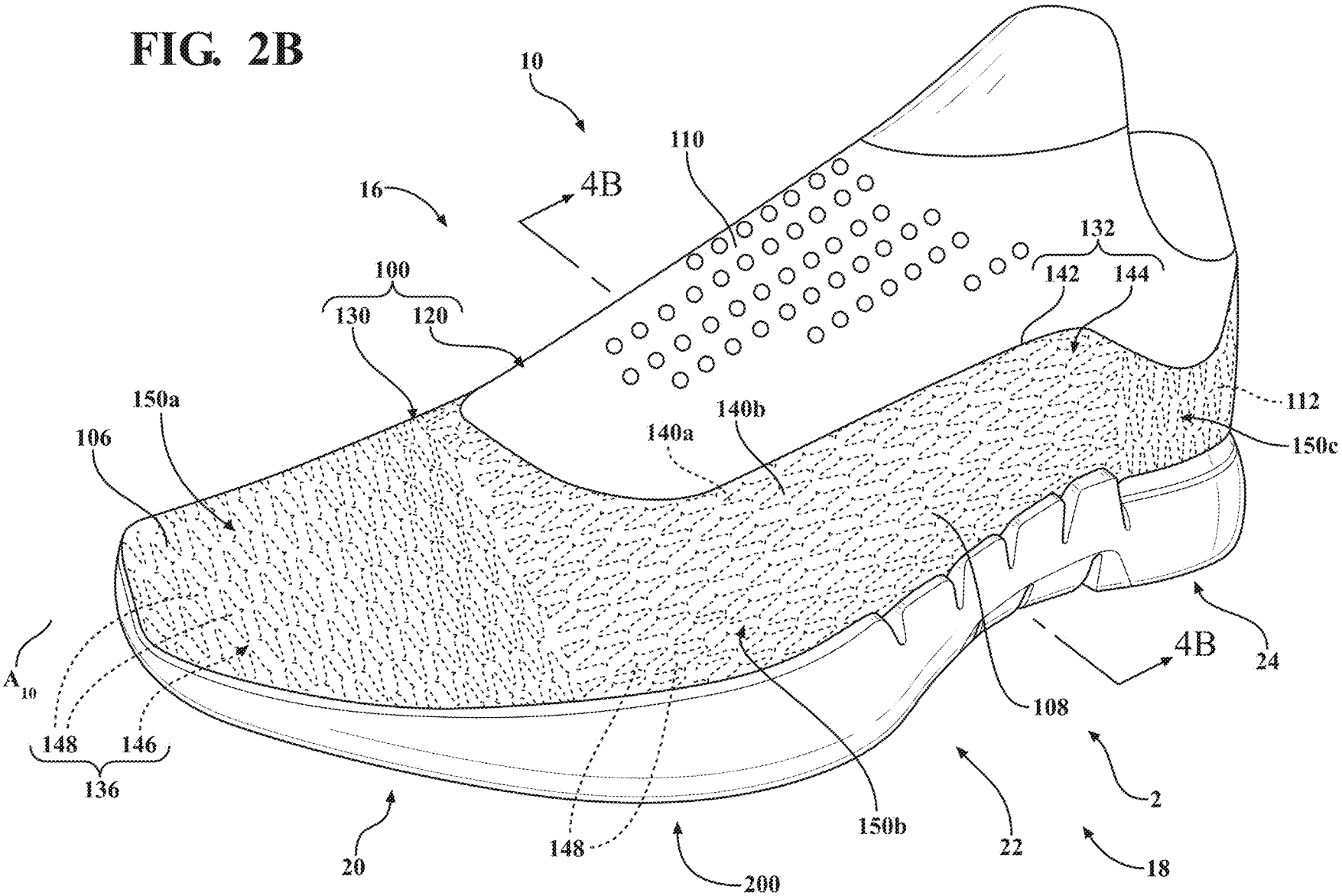
FIG. 2B is a front perspective view of the article of footwear of FIG. 1B, where the article of footwear in in the contracted state.

With continued reference to FIGS. 1A and 1B, the reliefs 148 of the compressible component 136 may be formed as polygonal-shaped apertures extending through the thickness of the compressible component 136. For instance, the reliefs 148 may be rectangular or parallelogram-shaped reliefs 148 including a length $L_{148}$ extending across a first pair of opposing corners and a width $W_{148}$ extending across a second pair of opposing corners that are arranged transverse (e.g., perpendicular) to the length $L_{148}$. In the illustrated example, the width $W_{148}$ of each relief 148 is less than the length $L_{148}$ such that the reliefs 148 are configured to collapse along the widthwise direction when the pressure is reduced within the chamber 144. Accordingly, orientations of the reliefs 148 may be selected depending on a desired transition between the expanded state and the constricted state.

In the illustrated example, the reliefs 148 of the compressible component 136 are arranged in a plurality of adjustment zones 150*a*, 150*b*, 150*c* to impart different transformation characteristics along the upper 100. For example, the compressible component 136 includes a first adjustment zone 150*a* arranged along the toe cap 106 of the upper 100 and including an array (e.g., rows and columns) of the reliefs 148 having widths $W_{148}$ oriented along a longitudinal direction (i.e., from an anterior end 12 to the posterior end 14) of the upper 100 and lengths $L_{148}$ oriented across (i.e., transverse to the longitudinal axis $A_{10}$) the upper 100. Thus, the reliefs 148 of the first adjustment zone 150*a* are configured to selective contract the toe cap 106 of upper 100 along the lengthwise direction over the toes.

The side portions of the compressible component 136 define a second adjustment zone 150*b* extending along the quarter panels 108 on each of the medial side 16 and the lateral side 18 in the mid-foot region 22. The second adjustment zone 150*b* includes an array of the reliefs 148 with widths $W_{148}$ oriented transverse or perpendicular to the longitudinal direction of the upper 100. Accordingly, the second adjustment zone 150*b* is configured to contract the upper 100 across the mid-foot region 22 of the on each of the medial side 16 and the lateral side 18. As discussed above, the throat 110 of the upper 100 is formed by an elastic material of the bootie 120. Thus, when the second adjustment zone 150*b* moves from the relaxed state to the constricted state, the throat 110 may be drawn upon and stretch around the dorsal surface (i.e., the instep) of the foot.

With continued reference to FIGS. 1A and 1B, the compressible component 136 includes a third adjustment zone 150*c* formed along the heel side panels 112 on each of the medial side 16 and the lateral side 18. The third adjustment zone 150*c* extends at least partially around a heel region of the upper 100 from a medial side to a lateral side. Here, the reliefs 148 are oriented with the widths $W_{148}$ aligned substantially parallel with the sole structure 200 and the lengths $L_{148}$ oriented along a direction from the sole structure 200 to the ankle opening 104. Accordingly, the third adjustment zone 150*c* is configured to constrict the upper 100 around the heel of the foot. The posterior end 14 of the heel counter 114 includes an elastic material of the bootie 120 and is configured to stretch around the heel as the adjustment element 130 is moved from the relaxed state to the constricted state.

The compressible component 136 includes one or more resilient materials configured to bias the adjustment element 130 and the upper 100 towards expanded or relaxed state. For example, the compressible component 136 may include an elastomeric material, such as an ethylene-vinyl acetate foam. In other examples, the compressible component 136 may include unfoamed polymers, such as thermoplastic polyurethane. Optionally, the compressible component may include fiber-reinforced elastomeric materials. In addition to including different materials, the, lattice structure 146 may include different geometrical configurations to impart different constriction profiles in different areas of the upper 100. Examples of different geometries are discussed below with respect to FIGS. 11A-11E. Optionally, a thickness of the compressible component 136 ranges from 4 mm to 6 mm to provide the upper 100 with a relatively low profile while also providing sufficient structural strength for biasing the upper 100 to the expanded or relaxed state.

In use, the upper 100 is moved between the relaxed state and the constricted state by adjusting a fluid pressure within the interior void 134. For example, the pressure within the interior void 134 may be reduced by drawing a vacuum within the interior void 134 through a port 126 attached to the bladder 132. The vacuum may be drawn using a pressure source, such as a pump 160 integrated within the footwear 10 or provided as a peripheral (i.e., independent) accessory to the footwear 10. For illustrative purposes, the pump 160 of the present example is shown disposed in the heel region 24 of the sole structure 200. However, the pump 160 may be attached or disposed in any portion of the article of footwear 10, such as on the upper 100 or in other regions of the sole structure 200. Further, the pump 160 may be a peripheral accessory not attached to the shoe, such as a hand pump. As the pressure is reduced (e.g., below ambient) within the interior void 134, the lattice structure 146 collapses along the width-wise directions of the reliefs 148 and the upper 100 constricts around the foot. Conversely, to move the upper 100 to the relaxed state, the pressure within the interior void 134 is increased and the resilient material and/or geometry of the lattice structure 146 biases the upper 100 towards the expanded state.

With particular reference to FIGS. 5A-6B, another example of a configuration of an article of footwear 10*a* having an integrated adjustment element 130*a* is shown. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The article of footwear 10*a* shown in FIGS. 5A-6B includes an upper 100*a* and a sole structure 200 attached to the upper 100*a*. The upper 100*a* includes the bootie 120 and an adjustment element 130*a* attached to the bootie 120. Unlike the previous example of FIGS. 1A-3 where the bootie 120 is exposed along the throat 110, the adjustment element 130*a* of the upper 100*a* of the present example extends over the throat 110 from the medial quarter panel 108 to the lateral quarter panel 108. Thus, the adjustment element 130*a* is configure to selectively constrict the upper 100*a* along the dorsal surface of the foot. The adjustment element 130*a* includes a bladder 132*a* forming an interior void 134*a* having a compressible component 136*a* disposed therein. As discussed in greater detail below, the compressible component 136*a* is operable to transition the adjustable element 130*a* and the upper 100*a* between a relaxed state (FIG. 5A) and a constricted state (FIG. 5B).

In the illustrated example, the adjustment element 130*a* includes the inner barrier layer 140*a* and the outer barrier layer 140*b* defining at least a portion of an exterior surface of the upper 100*a*. Interior surfaces of the barrier layers 140*a*, 140*b* face each other and are joined to each other at discrete locations to form one or more seams 142*a*, 142*b* that separate the interior void 134*a* of the bladder 132*a* into one or more chambers 144*a*, 144*b*. In the illustrated example, the adjustment element 130*a* includes peripheral seams 142*a* sealing the interior void 134*a* and an interior seam 142*b* defining a flexure that separates the interior void 134*a* into an anterior chamber 144*a* and a posterior chamber 144*b*. Thus, the interior seam 142*b* allows the upper 100*a* and the adjustment element 130*a* to articulate along the metatarsophalangeal (MTP) joint of the foot. Optionally, the seams 142*a*, 142*b* may include perforations 122 or a breathable material to allow air transfer between the interior void 102 of the upper 100*a* and the exterior of the upper 100*a*.

The compressible component 136*a* is disposed within the interior void 134*a* of the adjustment element 130*a* and forms a transformable structure operable to transition the upper 100*a* between the relaxed state and the constricted state. In this example, the compressible component 136*a* includes a collapsible lattice structure 146 having a plurality of the apertures or reliefs 148 formed through a thickness (i.e., direction from the inner barrier layer 140*a* to the outer barrier layer 140*b*) of the compressible component 136*a*. Generally, when a pressure within the chambers 144*a*, 144*b* is reduced, the lattice structure 146 is configured to collapse within chambers 144*a*, 144*b* to transition the adjustment element 130*a* and the upper 100*a* from the relaxed state to the constricted state. Optionally, the compressible component 136*a* may be attached to the interior surface of one or both of the barrier layers 140*a*, 140*b*.

In the illustrated example, the reliefs 148 of the compressible component 136*a* are arranged in a plurality of adjustment zones 150*a*, 150*d*, 150*e*, 150*e* to impart different transformation characteristics along the upper 100*a*. For example, the anterior chamber 144*a* includes the first adjustment zone 150*a* and a second adjustment zone 150*d*. The second adjustment zone 150*d* has a second array of the reliefs 148 extending between the first adjustment zone 150*a* and the interior seam 142*b* with widths $W_{148}$ oriented transverse or perpendicular to the longitudinal direction of the upper 100*a*. Accordingly, the second adjustment zone 150*d* is configured to constrict the upper 100*a* across a ball region of the foot from the medial side 16 to the lateral side 18 of the upper 100*a*.

Figure 5A:
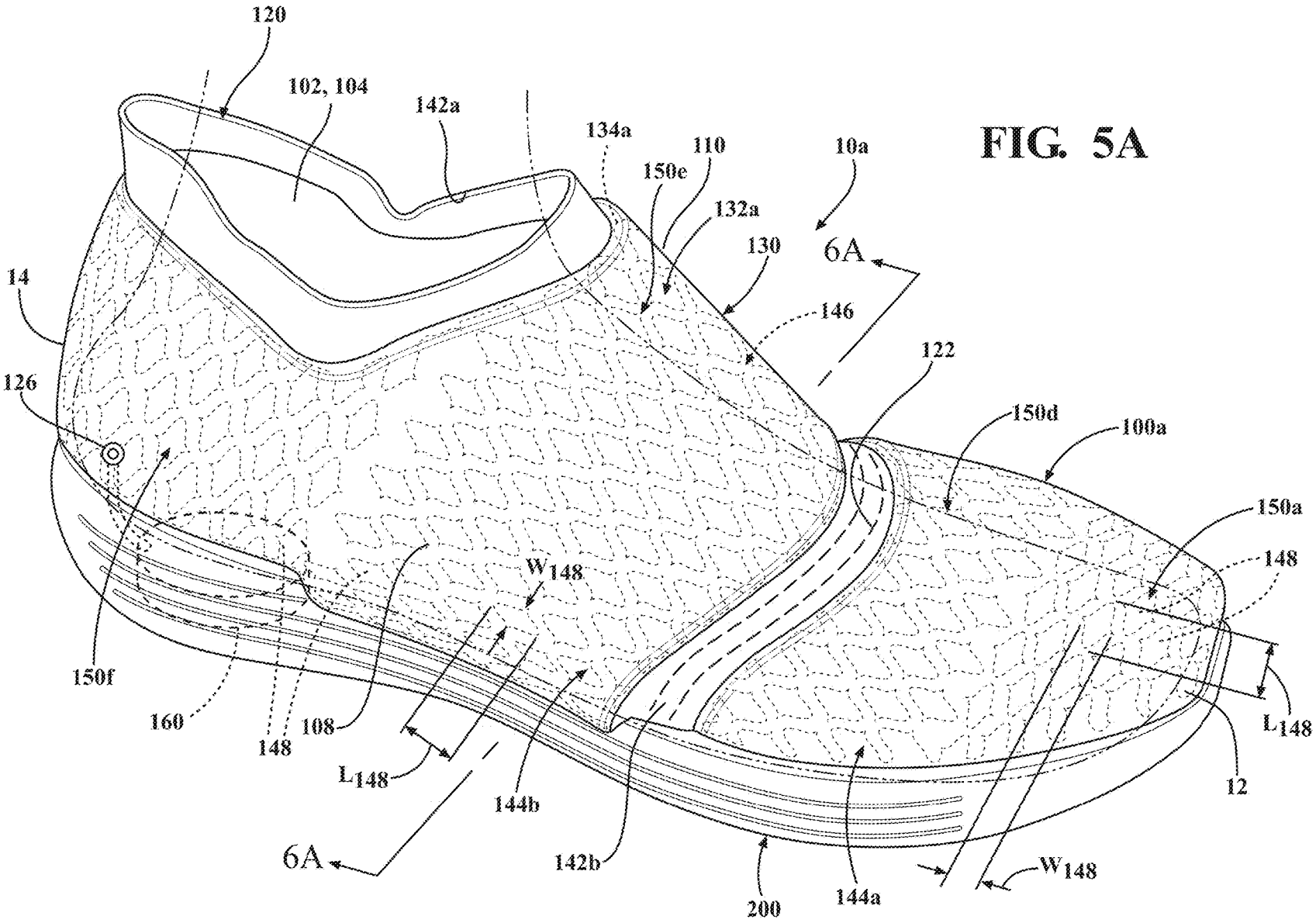
FIG. 5A is a perspective view of another example of an article of footwear according to the principles of the present disclosure, where the article of footwear is in a relaxed state.
Figure 5B:
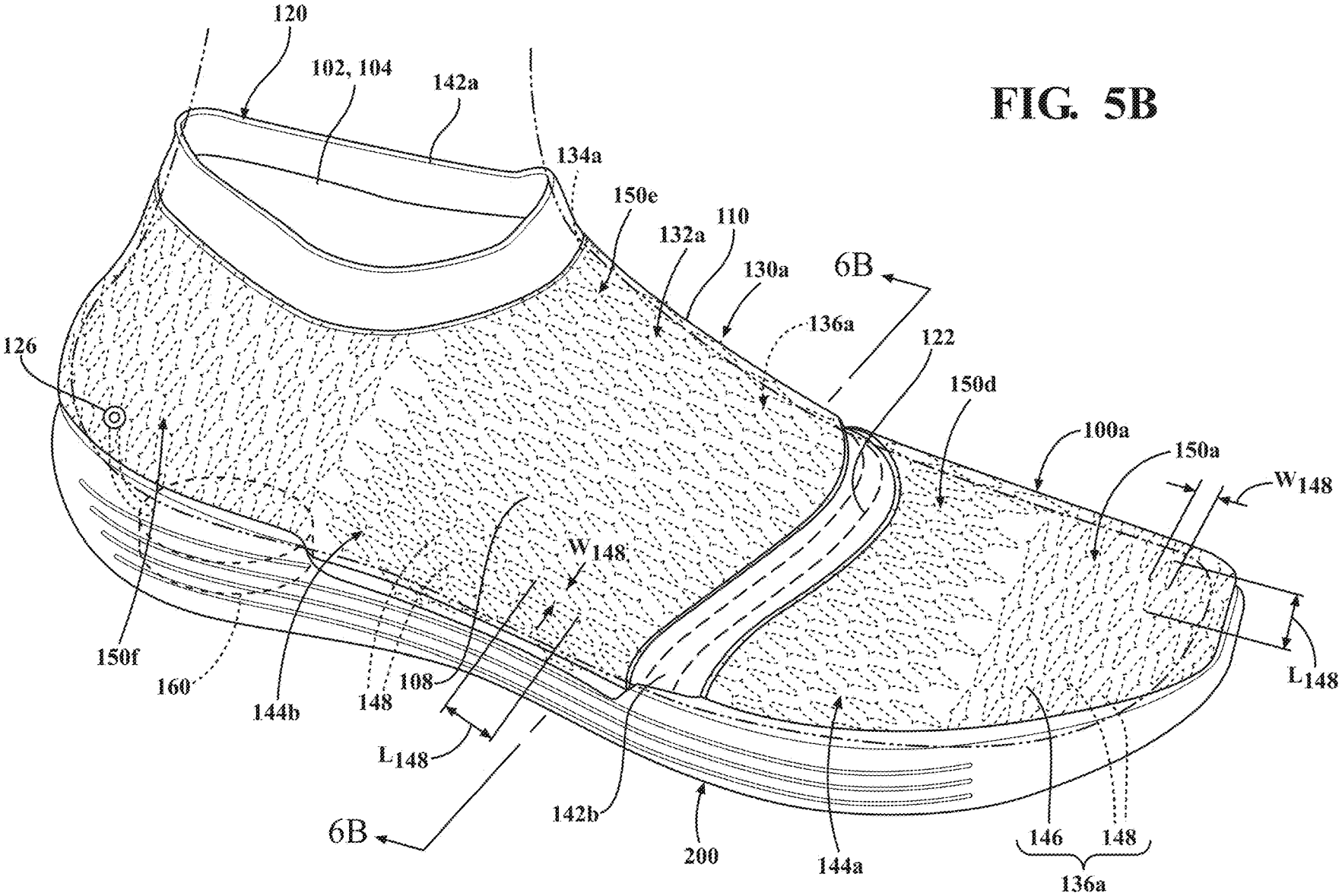
FIG. 5B is a perspective view of the article of footwear of FIG. 5A, where the article of footwear is in a contracted state.

With continued reference to FIGS. 5A and 5B, the compressible component 136*a* includes a third adjustment zone 150*e* and a fourth adjustment zone 150*f* disposed in the posterior chamber 144*b*. The third adjustment zone 150*e* is disposed along a mid-foot region of the upper 100*a* and includes an array of the reliefs 148 having widths $W_{148}$ oriented transverse to the longitudinal direction of the upper 100*a*, similar to the reliefs 148 of the second adjustment zone 150*d*. Accordingly, the third adjustment zone 150*e* is configured to constrict the upper 100*a* across the mid-foot region of the foot from the medial side 16 to the lateral side 18. The fourth adjustment zone 150*f* extends continuously around the heel counter 114 of the upper 100*a* from the medial side 16 to a lateral side 18. Here, the reliefs 148 are oriented with the widths $W_{148}$ aligned substantially parallel with the sole structure 200 and the lengths $L_{148}$ oriented along a direction from the sole structure 200 to the ankle opening 104. Accordingly, the fourth adjustment zone 150*f* is configured to constrict the upper 100*a* around the heel of the foot.

Figure 6A:
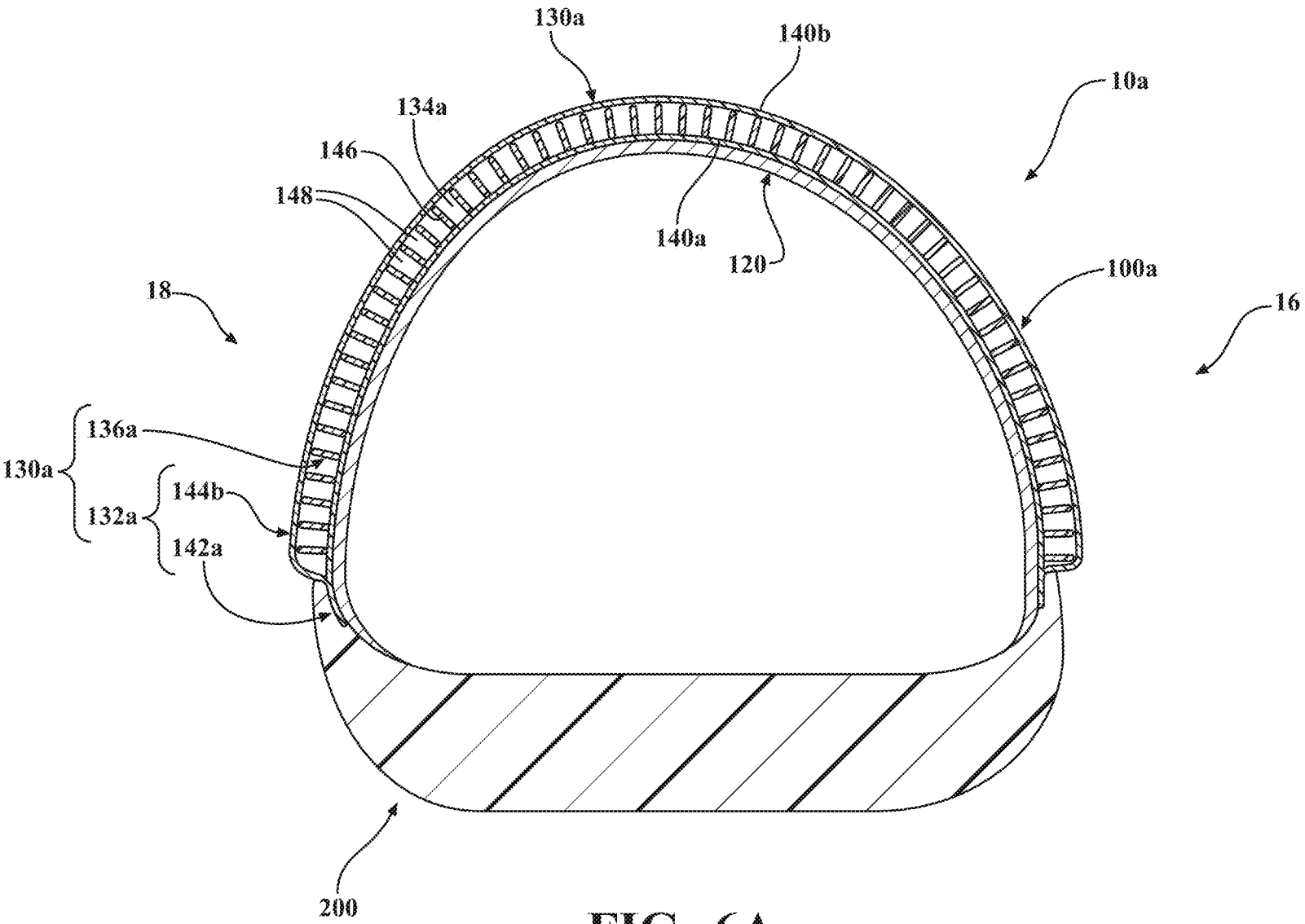
FIG. 6A is a cross-sectional view of the article of footwear of FIG. 5A, taken along Line 6A-6A in FIG. 5A.
Figure 6B:
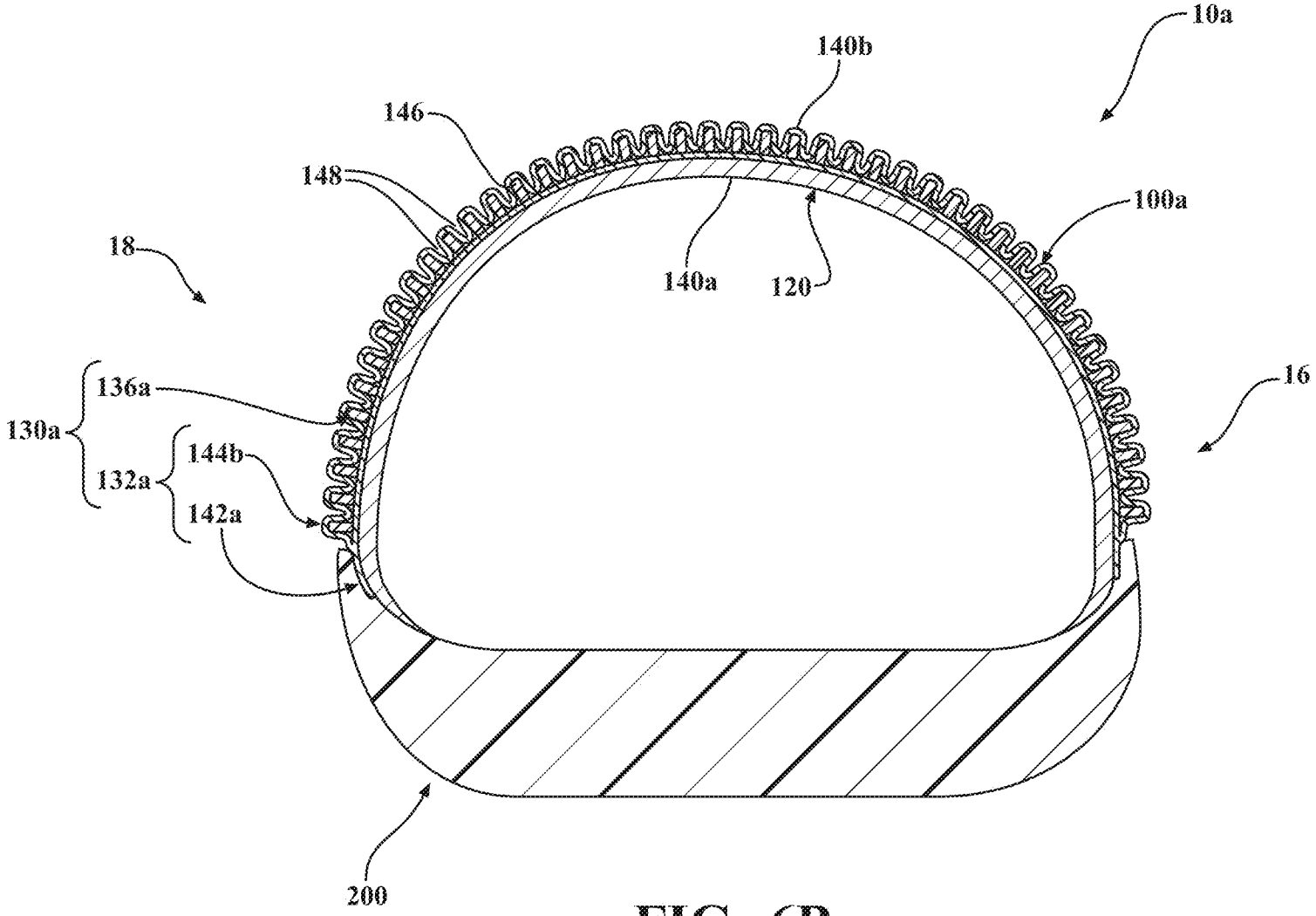
FIG. 6B is a cross-sectional view of the article of footwear of FIG. 5B, taken along Line 6B-6B in FIG. 5B.

FIGS. 6A and 6B illustrate a cross-sectional view of an example of the upper 100*a* transitioning from the relaxed state (FIG. 6A) to the constricted state (FIG. 6B). In FIG. 6A, the adjustment element 130*a* is in the relaxed state. As shown, the lattice structure 146 within the adjustment element 130*a* is expanded such that the reliefs 148 of the lattice structure 146 define a first width $W_{148}$. To move the adjustment element 130*a* to the constricted state, pressure within the interior void 134*a* of the adjustment element 130*a* is reduced until a vacuum force overcomes the opposing biasing force imparted by the resilient material of the compressible component 136*a* collapses the lattice structure 146 at the reliefs 148, transitioning the reliefs from the expanded width $W_{148}$ to a collapsed width $W_{148}$. As the adjustment element 130*a* collapses, the outer barrier layer 140*b* may be drawn into the reliefs 148 towards the inner barrier layer 140*a*. Optionally, the outer barrier layer 140*b* may contact the inner barrier layer 140*a* such that friction between the inner barrier layer 140*a* and the outer barrier layer 140*b* causes the upper 100*a* to increase in stiffness when the adjustment element 130*a* is in the constricted state. While FIGS. 6A and 6B provide an example of the adjustment element 130*a* across the third adjustment zone 150*e*, the adjustment zones 150*a*-150*c* of the article of footwear 10 and the adjustment zones 150*d*, 150*f* of the upper 100*a* function in a similar fashion.

With particular reference to FIGS. 7A-8B, another example of a configuration of an article of footwear 10*b* having an integrated adjustment element 130*b* is shown. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

Figure 7A:
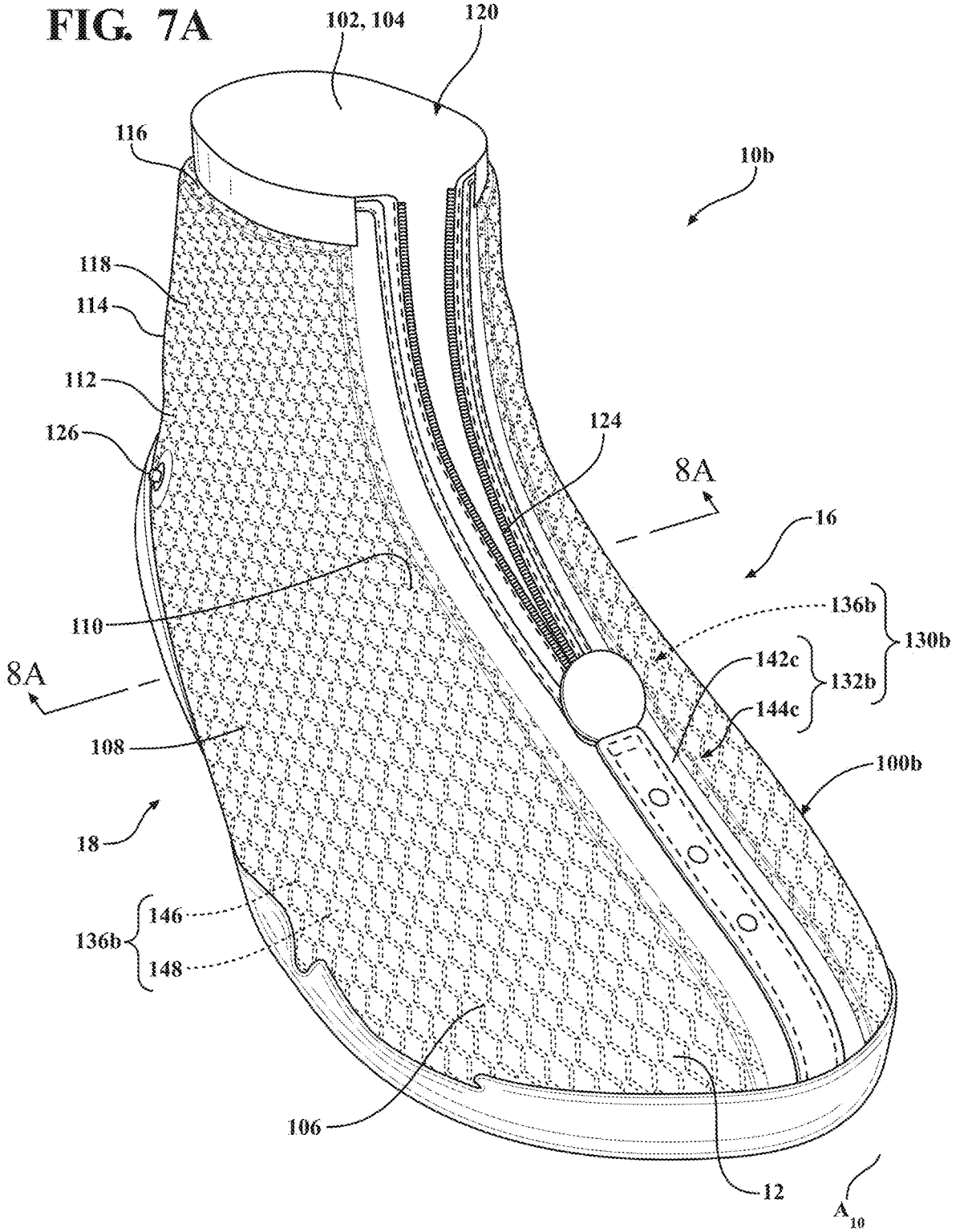
FIG. 7A is a front perspective view of another article of footwear according to the present disclosure, where the article of footwear is in a relaxed state.
Figure 7B:
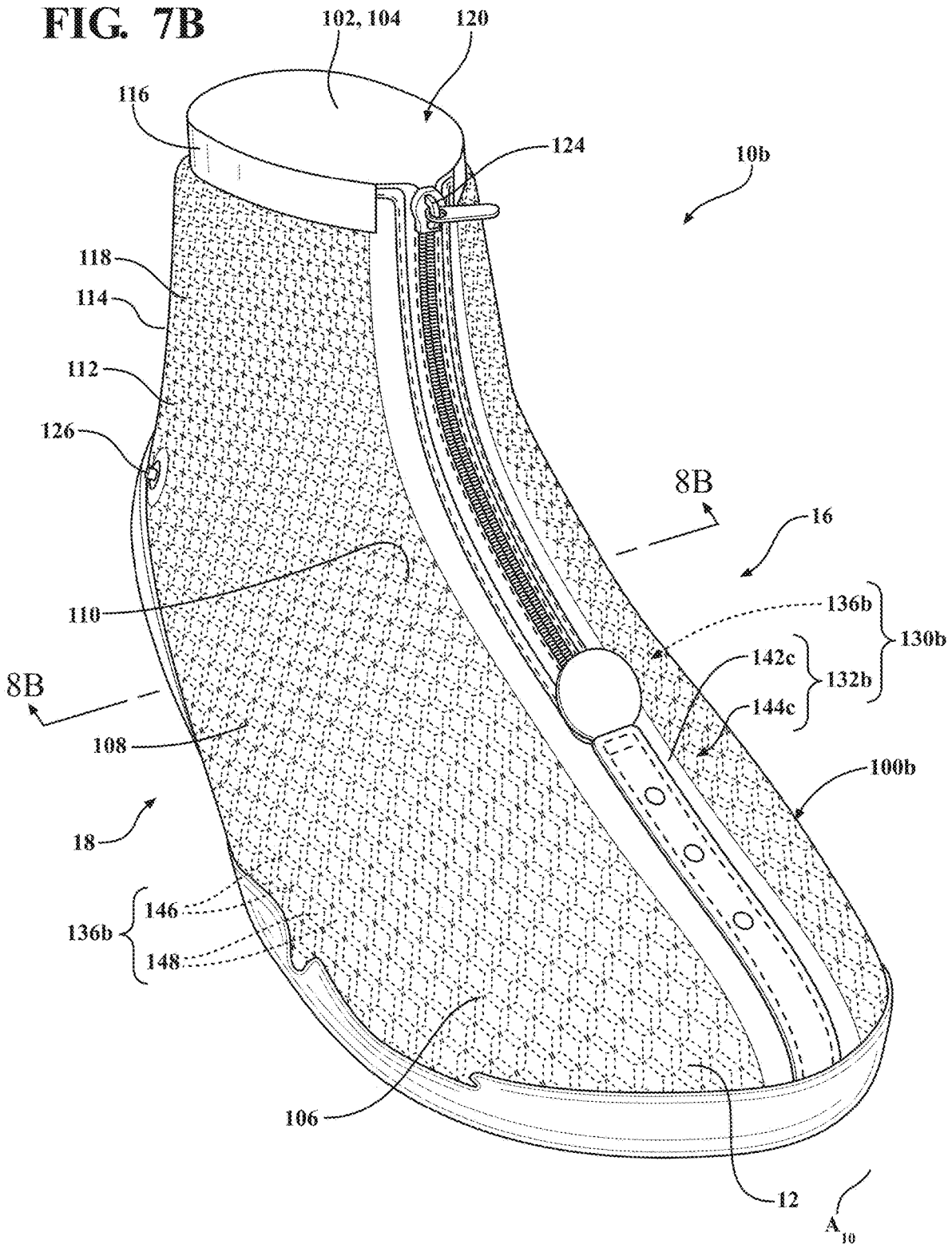
FIG. 7B is a front perspective view of the article of footwear of FIG. 7A, where the article of footwear is in a constricted state.
Figure 8A:
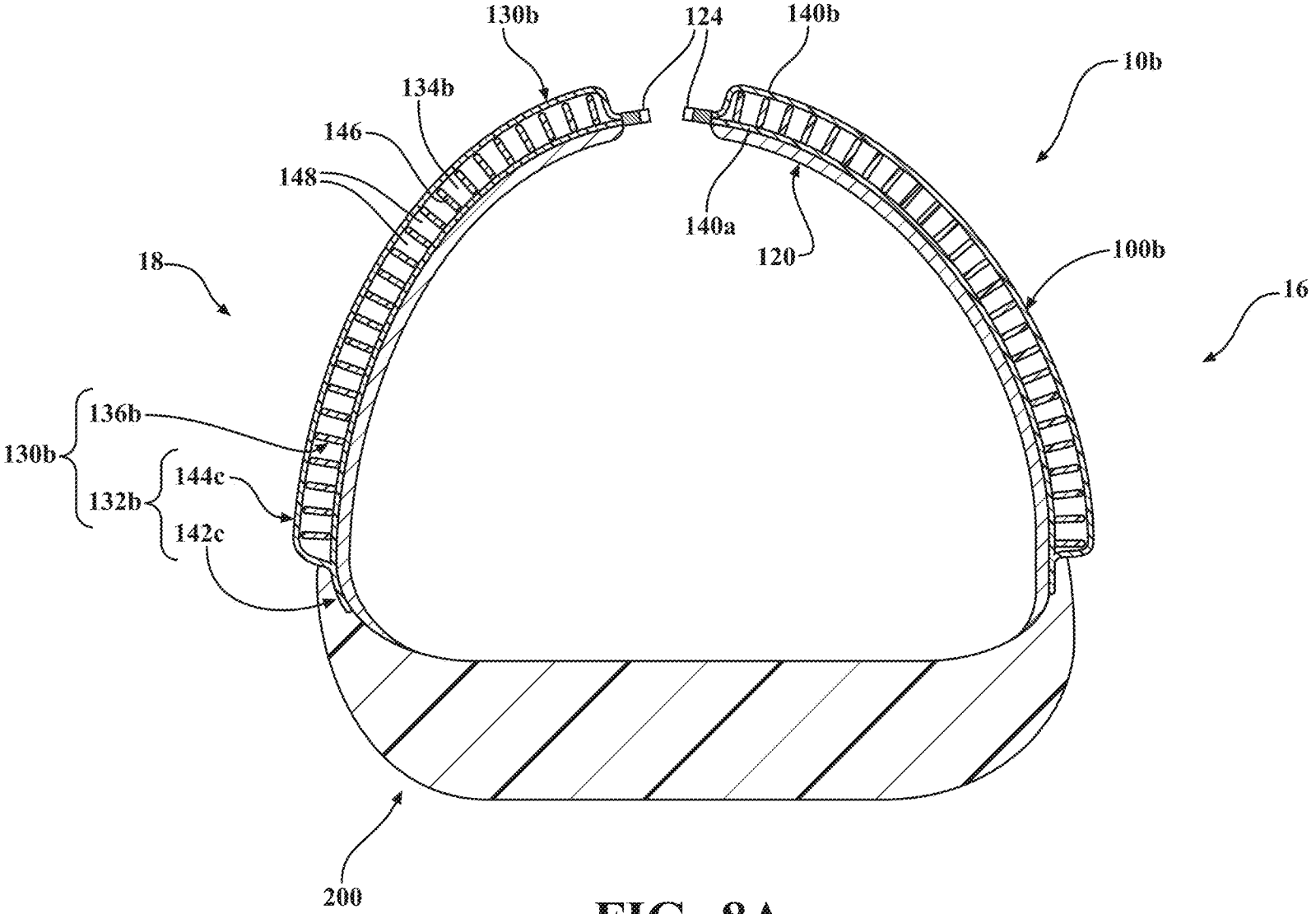
FIG. 8A is a cross-sectional view of the article of footwear of FIG. 7A, taken along Line 8A-8A in FIG. 7A.
Figure 8B:
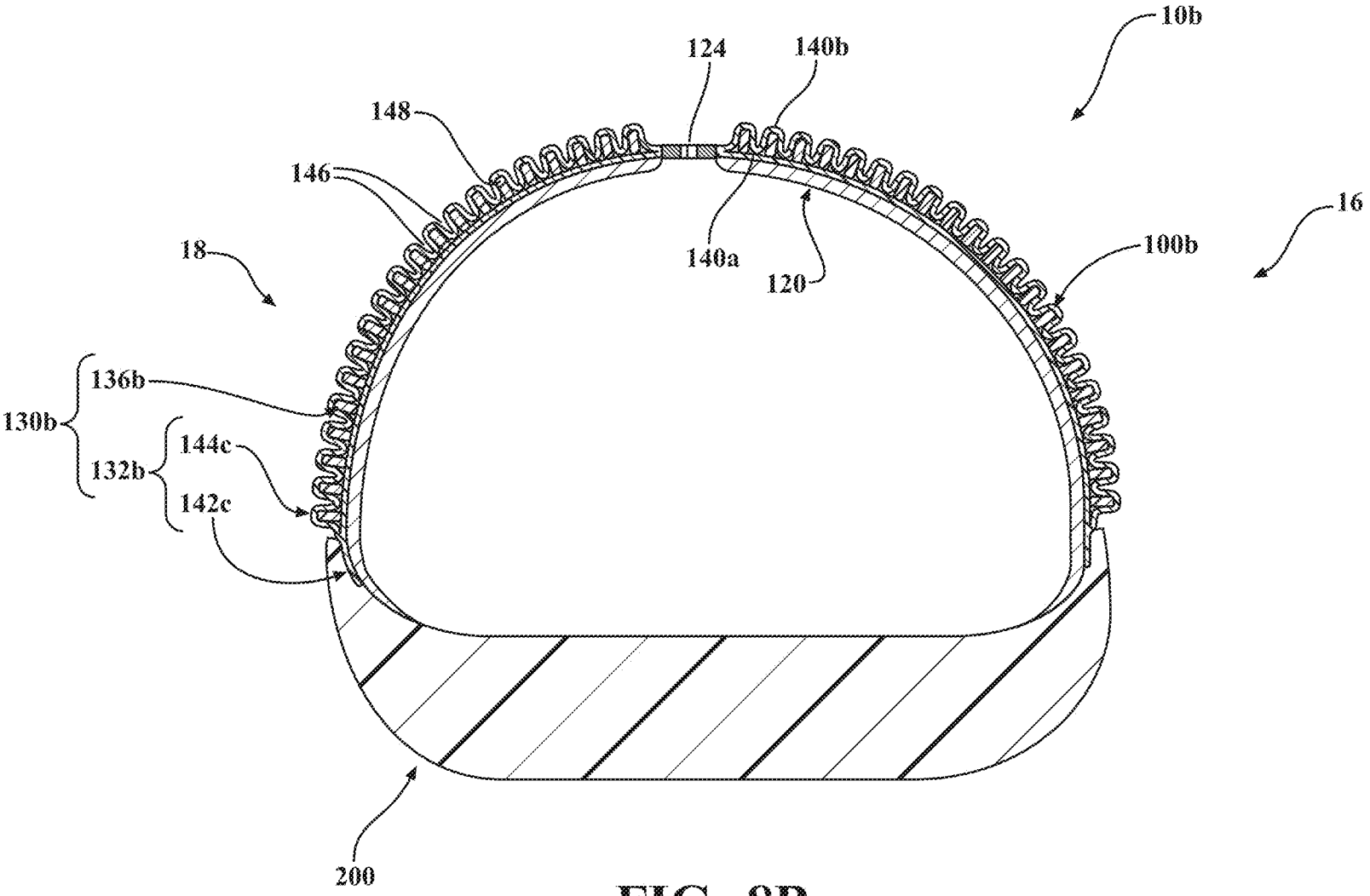
FIG. 8B is a cross-sectional view of the article of footwear of FIG. 7B, taken along Line 8B-8B in FIG. 7B.
Figure 9A:
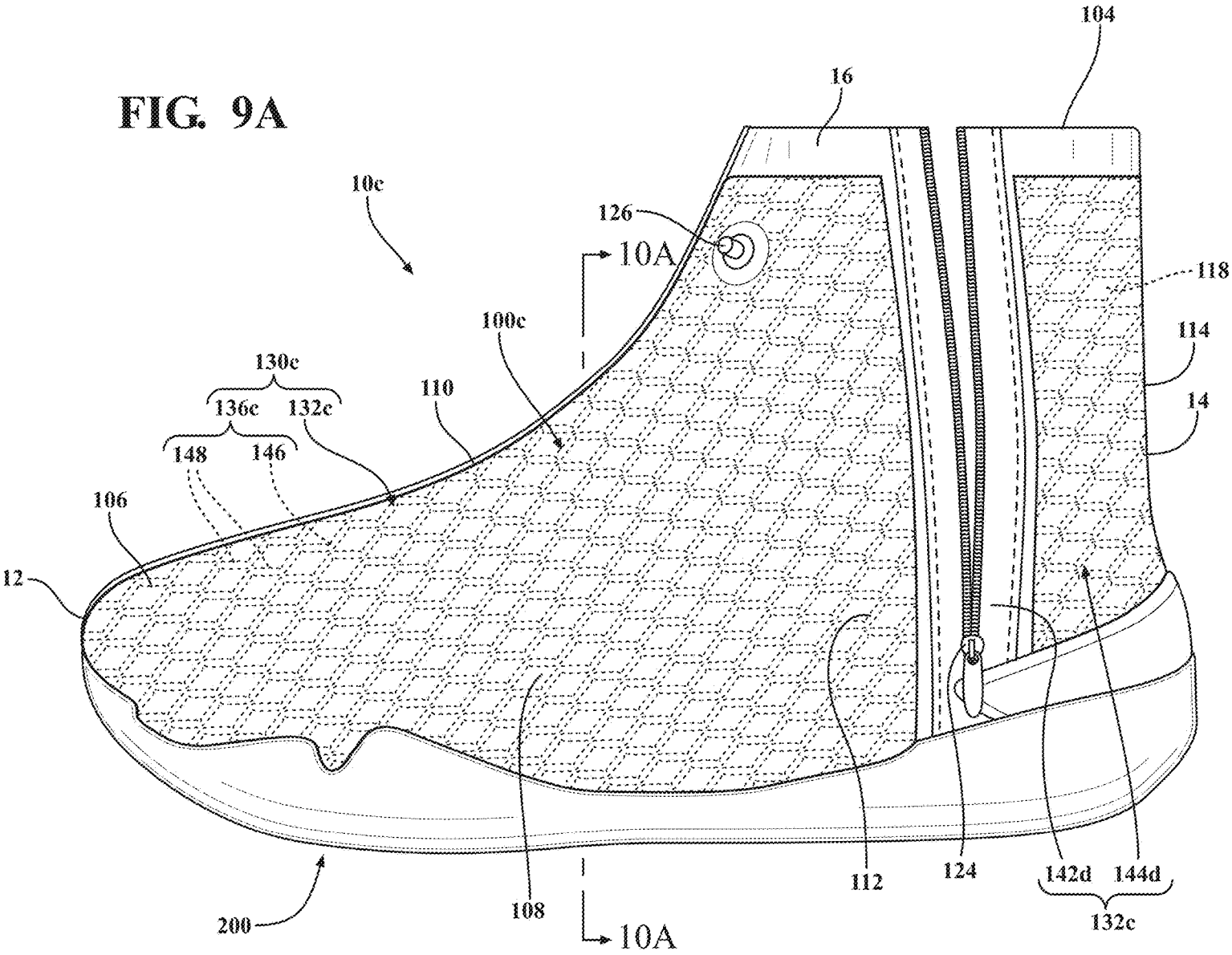
FIG. 9A is a front perspective view of another article of footwear according to the present disclosure, where the article of footwear is in a relaxed state.
Figure 9B:
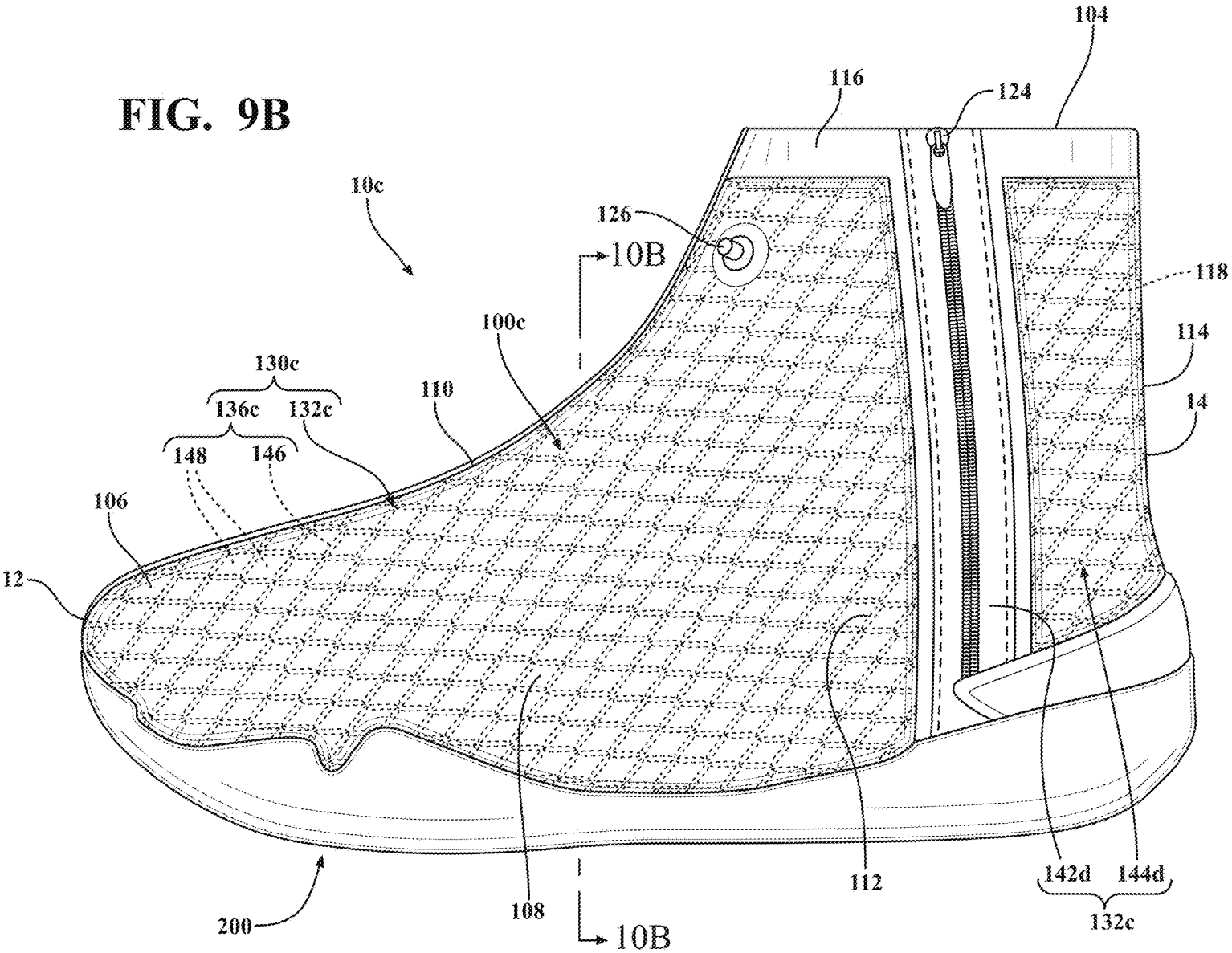
FIG. 9B is a front perspective view of the article of footwear of FIG. 9A, where the article of footwear is in a constricted state.
Figure 10A:
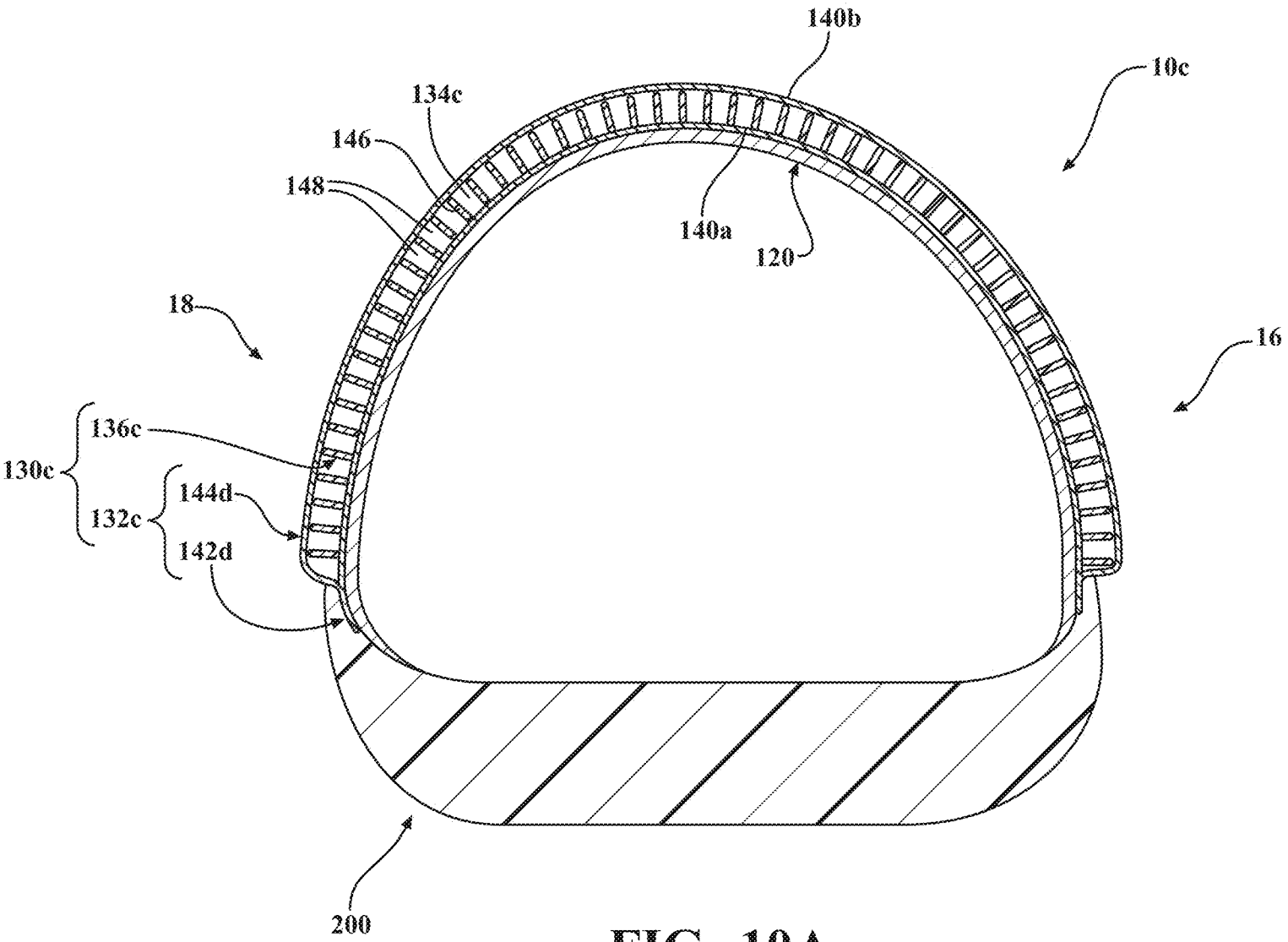
FIG. 10A is a cross-sectional view of the article of footwear of FIG. 9A, taken along Line 10A-10A in FIG. 9A.
Figure 10B:
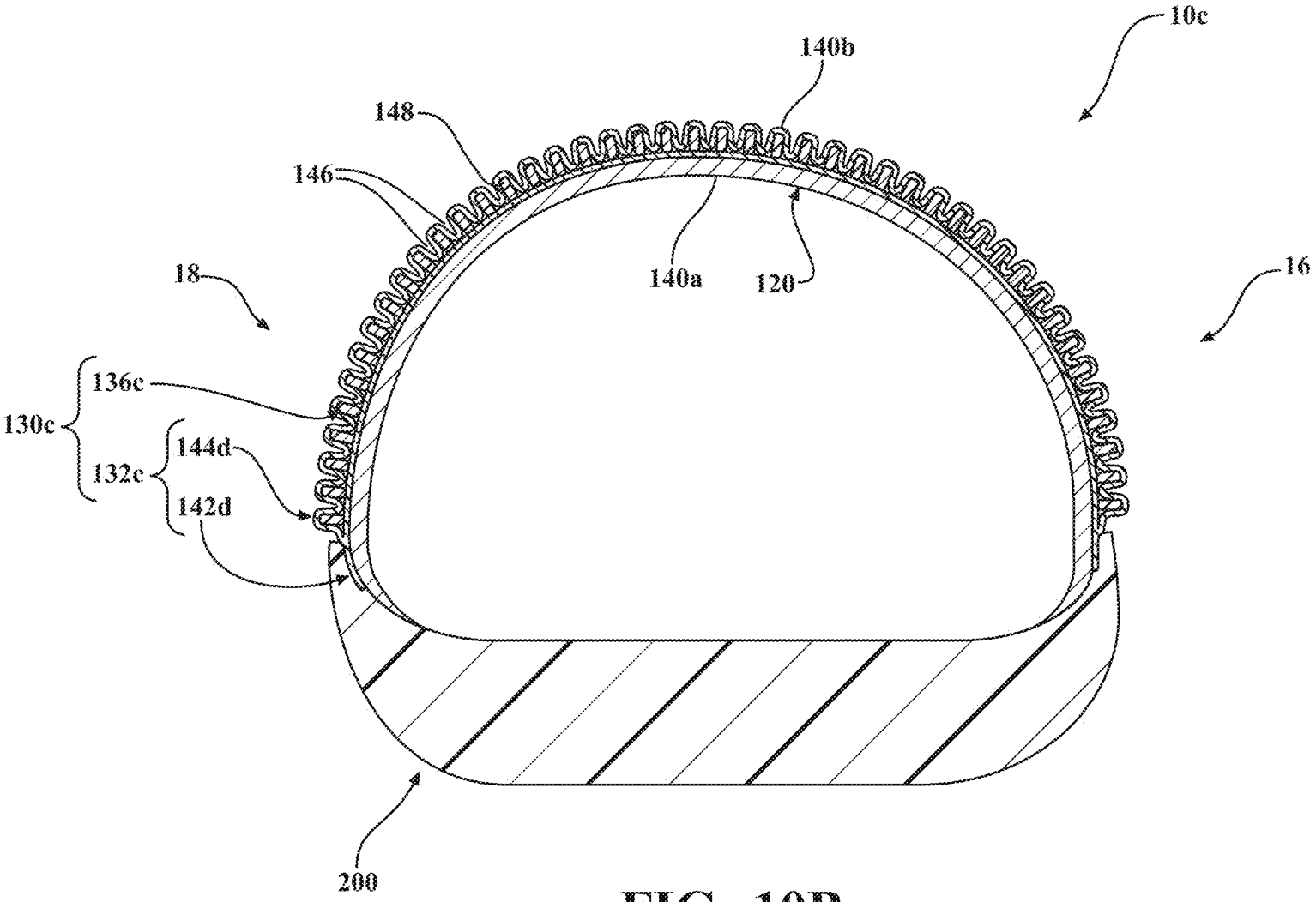
FIG. 10B is a cross-sectional view of the article of footwear of FIG. 9B, taken along Line 10B-10B in FIG. 9B.

The example of the article of footwear 10*b* shown in FIGS. 7A and 7B includes a high-top style upper 100*b* including a cuff 118 configured to extend around an ankle of a wearer between the heel counter 114 and the collar 116. As shown, a bootie 120 (best seen in FIGS. 8A-8B) of the upper 100*b* includes a closure 124 extending along the throat 110 to move the upper 100*b* between an open configuration and a closed configuration. In this example, the closure 124 includes a zipper 124 extending along a length of the throat 110 from the toe cap 106 to the collar 116. The closure 124 may include other mechanisms for moving the upper 100*b* between the open state and the closed state, such as buttons, straps, hooks, laces, etc. Optionally, as explained in further detail below, the adjustment element 130*b* may include a port 126 in fluid communication with an interior void 134*b* of a bladder 132*b* (both best seen in FIG. 8A). The port 126 can be selectively coupled to a pressure source, such as a pump, to increase or decrease pressure within the bladder 132*b*.

For example, the upper 100*b* may include an adjustment element 130*b* including a bladder 132*b* having an interior void 134*b* and a compressible component 136*b* disposed within the interior void 134*b*. In this example, the adjustment element 130*b* extends along the entire upper 100*b* except for the closure 124 and an optional interior seam 142*c* extending along the longitudinal axis $A_{10}$ and connecting anterior end 12 to the closure 124. As shown, the adjustment element 130*b* includes a single chamber 144*c* having a unitary lattice structure 146 and reliefs 148 extending along the toe cap 106, quarter panels 108, heel side panels 112, the heel counter 114, and the cuff 118. While the illustrated example of the compressible component 136*b* includes a homogenous lattice structure 146, the compressible component 136*b* may have a variable lattice structure 146 tuned to constrict in different directions or amounts around the foot, as discussed below with respect to FIGS. 11A-11E and as shown in the previous arrangements discussed above. Thus a first portion of the compressible component 136*b* may include a first material and/or lattice configuration and a second portion of the compressible component 136*b* may include a second material and/or lattice configuration.

With particular reference to FIGS. 9A-10B, another example of a configuration of an article of footwear 10*c* having an integrated adjustment element 130*c* is shown. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

The article of footwear 10*c* includes an upper 100*c* similar to the upper 100*b* previously described. Thus, the upper 100*c* includes an adjustment element 130*c* having a bladder 132*c* and a compressible component 136*c*. The bladder 132*c* includes a peripheral seam 142*d* and a chamber 144*d*. In this example, the upper 100*c* includes a closure 124 extending along the heel side panel 112 from the sole structure 200 to the collar 116 on one of the medial side 16 or lateral side 18 of the ankle opening 104. The closure 124 may be moved between an open configuration (FIG. 9A) and a closed configuration (FIG. 9B) to selectively increase the size of the ankle opening 104, thereby easing donning and doffing of the article of footwear 10*c*.

In the present example, the adjustment element 130*c* extends over the throat 110 of the upper 100*c*. The compressible component 136*c* is disposed within an interior void 134*c* of the bladder 132*c* and includes a homogenous lattice structure 146. However, the lattice structure 146 and reliefs 148 may be variable and include different properties in different zones or regions of the upper 100*c*. Generally, when a pressure within the chamber 144*d* is reduced, the lattice structure 146 is configured to collapse within chamber 144 to transition the adjustment element 130*c* and the upper 100*c* from the relaxed state (FIG. 10A) to the constricted state (FIG. 10B), as discussed previously. Optionally, the compressible component 136*c* may be attached to the interior surface of one or both of the barrier layers 140*a*, 140*b*.

FIGS. 11A-11E illustrate swatches 1000*a*-1000*e* having different examples of materials and configurations for lattice structures 146 and reliefs 148. As discussed above, the compressible components 136-136*c* may include homogenous lattice structures 146 or may include variable lattice structures 146 including any combination of the materials or configurations shown in the swatches 1000*a*-1000*e* of FIGS. 11A-11E.

Figure 11A:
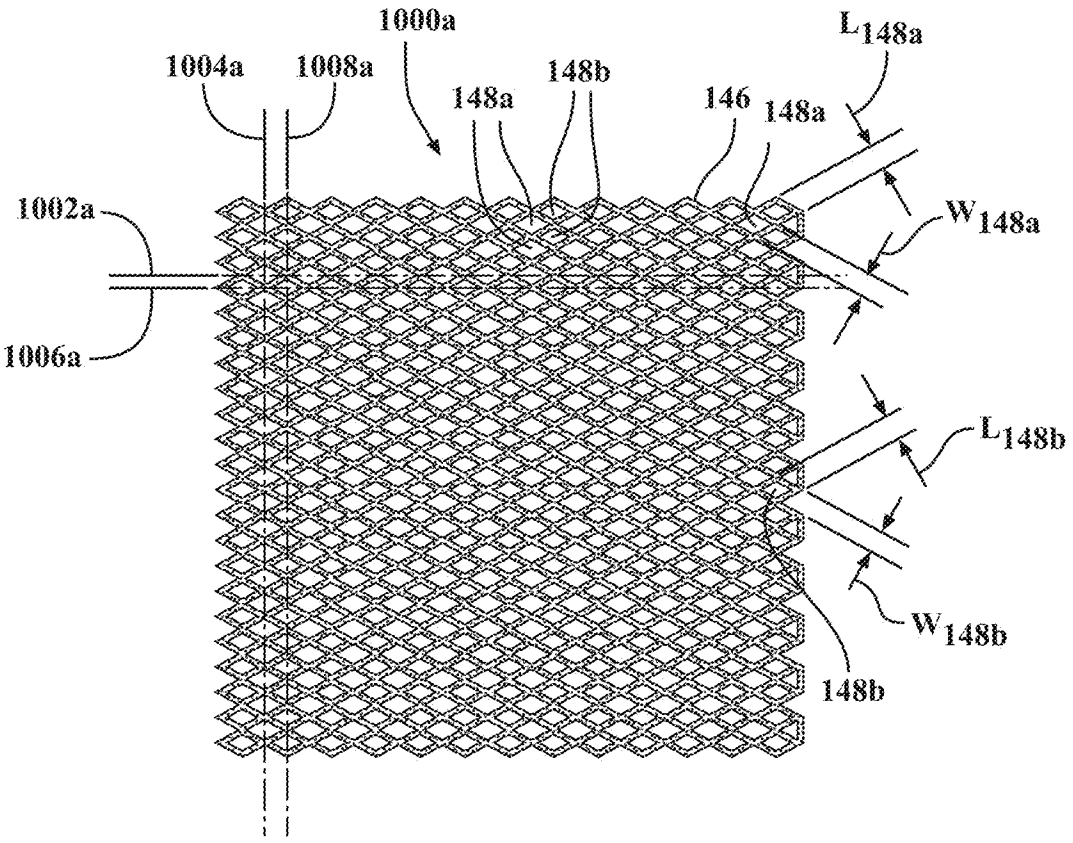
FIGS. 11A-11E show example swatches of lattice structures and materials for compressible components according to the present disclosure.

FIG. 11A shows a lattice structure swatch 1000*a* including a non-foamed polymer material. Optionally, the polymer material may include fiber reinforcement (e.g., glass fibers). The lattice structure swatch 1000*a* may be described as including a staggered array of parallelogram-shaped reliefs including first reliefs 148*a* having first lengths $L_{148a}$ and widths $W_{148a}$ and second reliefs 148*b* having second lengths $L_{148b}$ and widths $W_{148b}$ that are less than the first reliefs 148*a*. As shown, the first reliefs 148*a* are arranged corner-to-corner with each other in first rows 1002*a* and first columns 1004*a* and the second reliefs 148*b* are arranged corner-to-corner with each other in second rows 1006*a* and second columns 1008*a*. The first rows 1002*a* and second rows 1006*a* are alternatingly arranged such that each consecutive one the second reliefs 148*b* in each second row 1006*a* is received between a consecutive pair of the first reliefs 148*a*, and vice versa. The alternating arrangement of the reliefs 148*a*, 148*b* provides a combination of increased range of motion among the larger first reliefs 148*a* and stiffness among the smaller second reliefs 148*b*. Sizes and thicknesses of the lattice may be selected to tune performance of the structure.

Figure 11C:
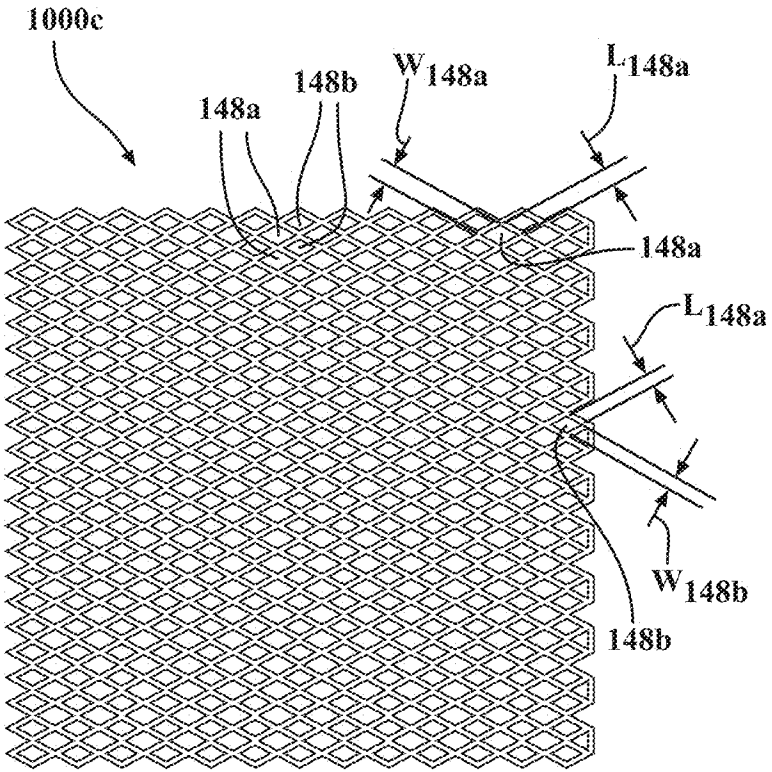
Figure 11B:
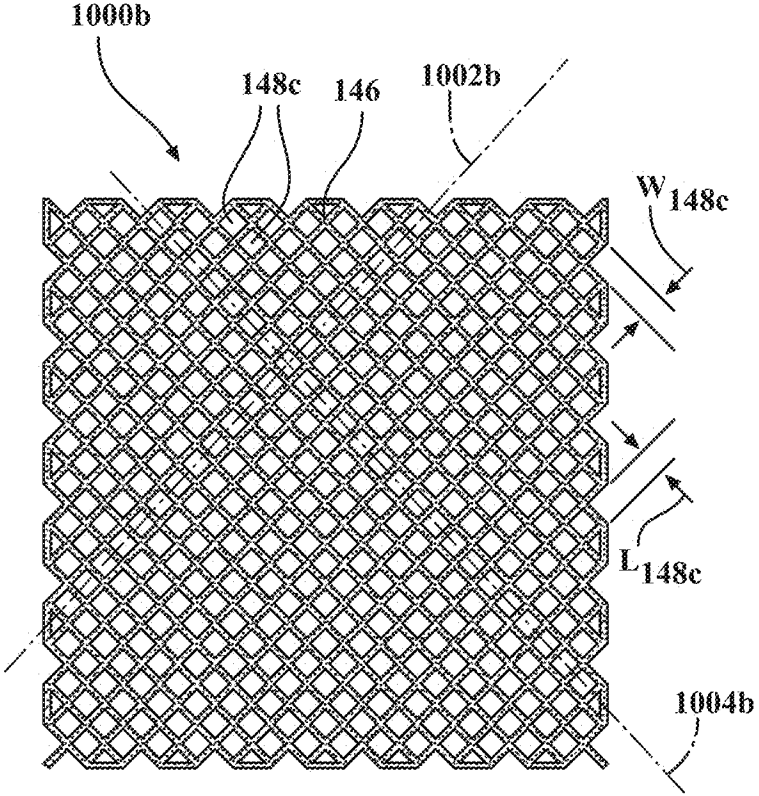

FIG. 11B shows another lattice structure swatch 1000*b* including a non-foamed polymer material. Here, the lattice structure swatch 1000*b* may be described as including a diagonal rectangular array configuration including a homogenous arrangement of rectangular reliefs 148*c* arranged in diagonal rows 1002*b* and columns 1004*b* to form a grid pattern. As may be seen, the lengths $L_{148c}$ of the reliefs 148*c* are substantially the same as the dimension of the widths $W_{148c}$ of the reliefs 148*c*. As with the lattice structure swatch 1000*a*, thicknesses of the lattice and/or dimensions of the reliefs 148*b* may be modified to change properties of the lattice structure.

Figure 11E:
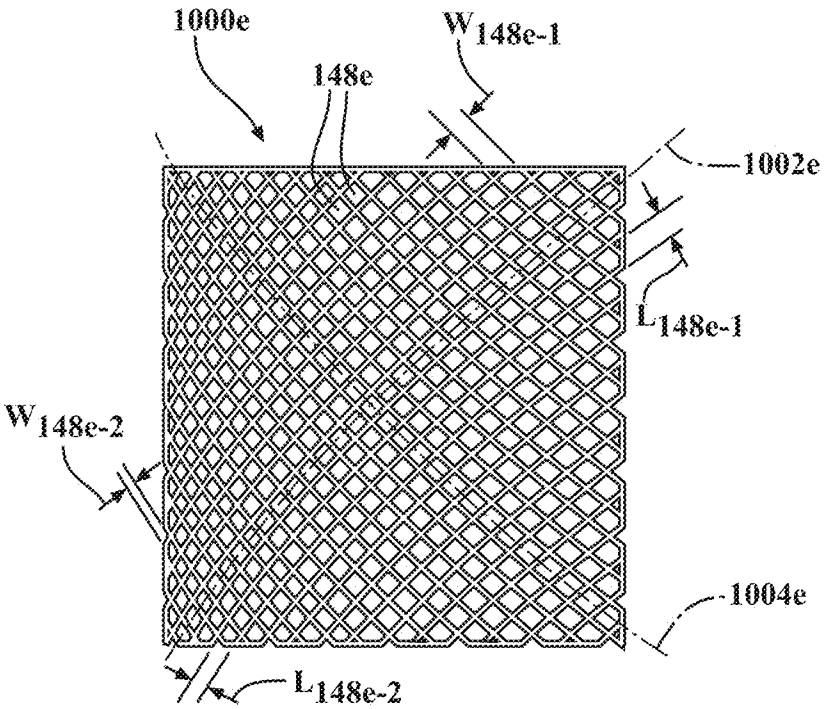
Figure 11D:
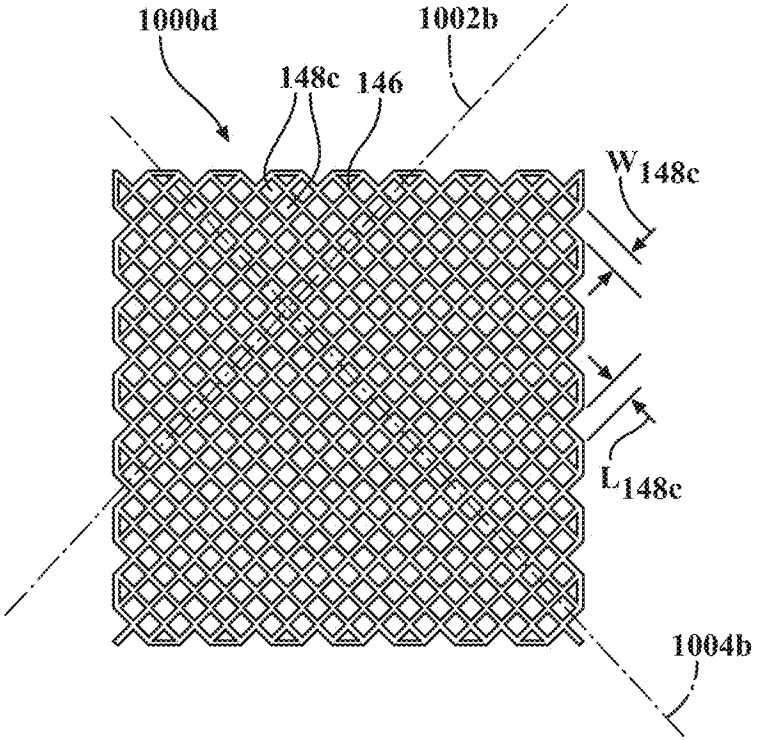

FIGS. 11C and 11D show examples of lattice structure swatches 1000*c*, 1000*d* including foamed elastomeric materials. The foamed elastomeric materials may include closed-cell or open-cell foams configured to collapse under pressure. Thus, in addition to the collapsible lattice structure defined by the reliefs 148, the material of the lattice structure may also collapse, allowing a thickness of a compressible component to compress between barrier layers 140*a*, 140*b* of an adjustment element. The lattice structure swatch 1000*c* has a staggered parallelogram shape similar to the lattice structure swatch 1000*a* and the lattice structure swatch 1000*d* has a rectangular array configuration similar to the lattice structure swatch 1000*b*.

In another example, FIG. 11E shows an example of a lattice structure swatch 1000*e* including a tapered rectangular array. Here, lattice structure swatch 1000*e* includes a plurality substantially rectangular reliefs 148*e* arranged in rows 1002*e* and columns 1004*e*. Each relief 148*e* includes a length $L_{148e}$ measured along the rows 1002*e* and a width $W_{148e}$ measured along the columns 1004*e*. In this example at least one of the length $L_{148e}$ and the width $W_{148e}$ tapers. For example, the lengths $L_{148e}$ of the reliefs 148*e* progressively tapers along the length of the row 1002*e* such that the reliefs 148*e* at one end of the row 1002*e* have a first length $L_{148e\text{-}1}$ that is greater than a second length $L_{148\text{-}2}$ of reliefs 148*e* at other end of the row 1002*e*. Additionally or alternatively, the widths $W_{148e}$ may progressively taper along the height of each column 1004*e* such that reliefs 148*e* at one of a column 1004*e* have a first width $W_{148e\text{-}1}$ that is greater than a second width $W_{148\text{-}2}$ of reliefs 148*e* at the other end of the column 1004*e*. The progressive taper results in the lattice structure having an arcuate profile where both the length $L_{148}$ and the width $W_{148}$ taper, as shown in FIG. 11E. The lattice structure swatch 1000*e* may include foamed and unfoamed materials.

As set forth above, any combination of the lattice structures shown in the lattice structure swatches 1000*a*-1000*e* may be incorporated in a single compressible component 136-136*b*. Additionally, different areas of a compressible component 136-136*b* may include different materials. Compressible components according to the present disclosure may be constructed using additive manufacturing methods (i.e., three-dimensional printing) to achieve complex and variable geometries. Furthermore, the use of additive manufacturing allows the use of different materials within a single lattice structure, and allows for different areas of the lattice structure to be uniquely tuned by adjusting lattice thicknesses as well as sizes, shapes, and orientations of reliefs.

Turning now to FIGS. 12A-12C, an example method for constructing the adjustment element 130 discussed previously is provided. While FIGS. 12A and 12B illustrate the compressible component 136 including the adjustment zones 150*a*-150*c*, similar principles would be applied in manufacturing the other adjustment elements 130*a*-130*c* discussed herein. Here, each adjustment zone 150*a*-150*c* includes a lattice structure 146 having staggered parallelogram configuration. Thus, the first adjustment zone 150*a* includes a first and second reliefs 148*a*, 148*b* having lengths oriented across a width of the compressible component 136, the second adjustment zone 150*b* includes first and second reliefs 148*a*, 148*b* having lengths oriented along a length of the compressible component 136, and the third adjustment zone 150*c* includes first and second reliefs 148*a*, 148*b* having lengths extending across the width of the compressible component 136. As provided previously, the compressible component 136 may be formed using an additive manufacturing process.

In FIG. 12C, the compressible component 136 is shown disposed between the inner barrier layer 140*a* and the outer barrier layer 140*b*. Opposing surfaces of the inner barrier layer 140*a* and the outer barrier layer 140*b* are joined to each around the periphery of the compressible component 136 to seal the compressible component 136 within an interior void 134 formed between the barrier layers 140*a*, 140*b*. Once formed, the adjustment element 130 can be incorporated into an upper 100, either by attaching the adjustment element 130 to an underlying substrate (e.g., the bootie 120) or by forming the upper 100 of the adjustment element 130.

The following Clauses provide an exemplary configuration for an adjustment element for an article of footwear and an article of footwear described above.

Clause 1. An adjustment element for an article of footwear, the adjustment element comprising a bladder including a barrier layer defining an interior void and a compressible component disposed within the interior void and including a lattice structure defining a plurality of reliefs formed in the lattice structure, the compressible component operable between an expanded state when the interior void includes a first pressure and a contracted state when the interior void includes a second pressure.

Clause 2. The adjustment element of Clause 1, wherein reliefs are parallelogram-shaped and extend through a thickness of the compressible component.

Clause 3. The adjustment element of any of the preceding Clauses, wherein the lattice structure defines a first adjustment zone including a first plurality of reliefs oriented in a first direction and a second adjustment zone including a plurality of reliefs oriented in a second direction different from the first direction.

Clause 4. The adjustment element of any of the preceding Clauses, wherein the compressible component includes a resilient polymeric material.

Clause 5. The adjustment element of Clause 4, wherein the resilient polymeric material is a foam material.

Clause 6. The adjustment element of any of the preceding Clauses, further comprising a port connected to the barrier layer and providing fluid communication between the interior void and a variable pressure source.

Clause 7. The adjustment element of any of the preceding Clauses, wherein the first pressure is equal to or greater than ambient pressure and the second pressure is less than ambient pressure.

Clause 8. The adjustment element of any of the preceding Clauses, wherein the adjustment element includes an interior seam separating the bladder into a first chamber and a second chamber.

Clause 9. The adjustment element of any of the preceding Clauses, wherein the adjustment element forms an upper of an article of footwear.

Clause 10. The adjustment element of Clause 9, wherein the compressible component includes a first plurality of the reliefs operable to contract in a first direction in a forefoot region of the upper and a second plurality of the reliefs operable to contract in a second direction in a mid-foot region of the upper.

Clause 11. An article of footwear comprising a bootie defining an interior void, and an adjustment element attached to the bootie and including a bladder having a barrier layer defining an interior void and a compressible component disposed within the interior void, the compressible component including a lattice structure defining a plurality of reliefs formed in the lattice structure, the compressible component operable between an expanded state when the interior void includes a first pressure and a contracted state when the interior void includes a second pressure.

Clause 12. The article of footwear of Clause 11, wherein reliefs are parallelogram-shaped and extend through a thickness of the compressible component.

Clause 13. The article of footwear of any of the preceding Clauses, wherein the lattice structure defines a first adjustment zone including a first plurality of the reliefs oriented in a first direction and a second adjustment zone including a second plurality of the reliefs oriented in a second direction different from the first direction.

Clause 14. The article of footwear of Clause 13, wherein the first plurality of the reliefs are operable to contract in a first direction in a forefoot region and the second plurality of the reliefs are operable to contract in a second direction in a mid-foot region.

Clause 15. The article of footwear of any of the preceding Clauses, wherein the compressible component includes a resilient polymeric material.

Clause 16. The article of footwear of Clause 15, wherein the resilient polymeric material is a foam material.

Clause 17. The article of footwear of any of the preceding Clauses, further comprising a port connected to the barrier layer and providing fluid communication between the interior void and a variable pressure source.

Clause 18. The article of footwear of any of the preceding Clauses, wherein the first pressure is equal to or greater than ambient pressure and the second pressure is less than ambient pressure.

Clause 19. The article of footwear of any of the preceding Clauses, wherein the adjustment element includes an interior seam separating the bladder into a first chamber and a second chamber.

Clause 20. The article of footwear of any of the preceding Clauses, wherein the bootie is exposed along a throat region of the article of footwear.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An adjustment element forming an upper of an article of footwear, the adjustment element comprising:

a bladder including a barrier layer defining an interior void; and a compressible component disposed within the interior void and including a foam lattice structure defining a plurality of reliefs formed in the lattice structure, a first plurality of the reliefs operable to contract in a first direction in a heel region of the upper and a second plurality of the reliefs operable to contract in a second direction in a mid-foot region of the upper, wherein the compressible component operates between an expanded state when the interior void includes a first pressure and a contracted state when the interior void includes a second pressure less than ambient pressure.

2. The adjustment element of claim 1, wherein reliefs of the plurality of reliefs are parallelogram-shaped and extend through a thickness of the compressible component.

3. The adjustment element of claim 1, wherein the lattice structure defines a first adjustment zone including the first plurality of reliefs oriented in the first direction and a second adjustment zone including the second plurality of reliefs oriented in the second direction different from the first direction.

4. The adjustment element of claim 1, wherein reliefs of the first plurality of the reliefs extend along a first longitudinal axis in the contracted state and reliefs of the second plurality of the reliefs extend along a second longitudinal axis that is substantially perpendicular to the first longitudinal axis.

5. The adjustment element of claim 1, further comprising a port connected to the barrier layer and providing fluid communication between the interior void and a variable pressure source.

6. The adjustment element of claim 1, wherein the first pressure is equal to or greater than ambient pressure.

7. The adjustment element of claim 1, wherein the adjustment element includes an interior seam separating the bladder into a first chamber and a second chamber.

8. The adjustment element of claim 1, wherein the compressible component comprises a closed-cell foam material.

9. The adjustment element of claim 1, wherein the bladder comprises a multilayer barrier layer.

10. The adjustment element of claim 1, wherein the compressible component is attached to an interior surface of the barrier layer.

11. An article of footwear comprising:

a bootie defining an interior void, and an adjustment element attached to the bootie and including a bladder having a barrier layer defining an interior void and a compressible component disposed within the interior void, the compressible component including a foam lattice structure defining a plurality of reliefs formed in the lattice structure, a first adjustment zone including a first plurality of the reliefs oriented in a first direction and operable to contract in the first direction in a heel region, and a second adjustment zone including a second plurality of the reliefs oriented in a second direction different from the first direction and operable to contract in the second direction in a mid-foot region, wherein the compressible component operates between an expanded state when the interior void includes a first pressure and a contracted state when the interior void includes a second pressure less than ambient pressure.

12. The article of footwear of claim 11, wherein reliefs of the plurality of reliefs are parallelogram-shaped and extend through a thickness of the compressible component.

13. The article of footwear of claim 11, further comprising a port connected to the barrier layer and providing fluid communication between the interior void and a variable pressure source.

14. The article of footwear of claim 11, wherein the first pressure is equal to or greater than ambient pressure.

15. The article of footwear of claim 11, wherein the adjustment element includes an interior seam separating the bladder into a first chamber and a second chamber.

16. The article of footwear of claim 11, wherein the bootie is exposed along a throat region of the article of footwear.

17. The article of footwear of claim 11, wherein the compressible component comprises a resilient polymeric material.

18. The article of footwear of claim 11, wherein the compressible component comprises a closed-cell foam material.

19. The article of footwear of claim 11, wherein the bladder comprises a multilayer barrier layer.

20. The article of footwear of claim 11, wherein the compressible component is attached to an interior surface of the barrier layer.

* * * * *